US005091945A

United States Patent [19]

Kleijn

[11] Patent Number: 5,091,945

[45] Date of Patent: Feb. 25, 1992

[54] SOURCE DEPENDENT CHANNEL CODING WITH ERROR PROTECTION

[75] Inventor: Willem B. Kleijn, Batavia, Ill.

[73] Assignee: AT&T Bell Laboratories, Murray Hill, N.J.

[21] Appl. No.: 414,155

[22] Filed: Sep. 28, 1989

[51] Int. Cl.[5] ..... G10L 9/18

[52] U.S. Cl. ..... 381/36; 381/30; 381/31

[58] Field of Search ..... 381/29–40; 364/513.5

[56] References Cited

U.S. PATENT DOCUMENTS 4,291,405 9/1981 Jayant et al. ..... 381/36
4,718,087 1/1988 Papamichalis ..... 381/34
4,899,385 2/1990 Ketchum et al. .

OTHER PUBLICATIONS

Kleijn et al., "Improved Speech Quality and Efficient Vector Quantization in SELP", ICASSP88, Apr. 11–14, 1988, New York, N.Y., pp. 155–158.

S. Kirkpatrick et al., "Optimization by Simulated Annealing", *Science*, vol. 220, 1983, pp. 671–680.

J. H. Chen et al., "Speech Coding for the Mobile Satellite Experiment", *Proc. IEEE Int. Conf. on Communications*, Jun. 1987, 756–763.

A. A. El Gamal et al., "Using Simulated Annealing to Design Good Codes", *IEEE Trans. Information Theory*, vol. IT-33, No. 1, 1987, pp. 116–123.

W. B. Kleijn et al., "An Efficient Stochastically Excited Linear Predictive Coding Algorithm for High Quality Low Bit Rate Transmission of Speech", *Speech Communication*, vol. VII, 1988, pp. 305–316.

N. Farvardin et al., "Optimal Quantizer Design for Noisy Channels: An Approach to Combined Source--Channel Coding", *IEEE Transactions on Information Theory*, vol. 33, No. 6, Nov. 1987, pp. 827–838.

*Primary Examiner*—Dale M. Shaw
*Assistant Examiner*—David D. Knepper
*Attorney, Agent, or Firm*—Ross T. Watland

[57] ABSTRACT

A parameter communication arrangement where a parameter that is transmitted over a channel using m-bit codewords or labels is quantized before transmission as one of only p levels, where, significantly, $p<k=2^m$. Since only p labels are needed to transmit the p levels, the unused k-p labels are advantageously available to provide redundancy. The receiver decodes the redundant labels in accordance with an error routine. An encoding table mapping from the p levels to p labels and a decoding table inverse mapping from the p labels to p levels are obtained using an optimization procedure to minimize the effect of channels errors. The optimization is based on the probability distribution for the p levels such that a relatively high proportion of the error protection made available by having redundant labels inures to the benefit of parameter levels which are more likely to be transmitted. The optimization procedure is a well known technique referred to as simulated annealing which is for the first time applied to source dependent channel coding.

25 Claims, 7 Drawing Sheets

PARAMETER X QUANTIZATION

| LEVEL | PROBABILITY |
|---|---|
| 0 | P(0) |
| 1 | P(1) |
| 2 | P(2) |
| 3 | P(3) |
| 4 | P(4) |
| 5 | P(5) |
| 6 | 0 |
| 7 | 0 |

PARAMETER X PROBABILITY DISTRIBUTION

| LEVEL | LABEL |
|---|---|
| 0 → | 010 |
| 1 → | 110 |
| 2 → | 111 |
| 3 → | 001 |
| 4 → | 000 |
| 5 → | 100 |

ENCODING TABLE 210 MAPPING FOR PARAMETER X

| LABEL | LEVEL |
|---|---|
| 010 → | 0 |
| 110 → | 1 |
| 111 → | 2 |
| 001 → | 3 |
| 000 → | 4 |
| 100 → | 5 |

DECODING TABLE 410 INVERSE MAPPING FOR PARAMETER X

| LABEL | LEVEL |
|---|---|
| 011 → | 0 |
| 101 → | 5 |

DECODING TABLE 410 ADDITIONAL MAPPING FOR PARAMETER X

SOURCE DEPENDENT CHANNEL CODING WITH ERROR PROTECTION

TECHNICAL FIELD

This invention relates to information processing and communication.

BACKGROUND AND PROBLEM

The code excited linear predictive (CELP) speech compression procedure has been shown to provide excellent speech quality at low bit rates. Since its original introduction in 1984, much effort has been spent to make the procedure feasible for commercial applications. Thus, while the original procedure was computationally extremely expensive, many different techniques are now available to reduce the computational effort. Its current level of maturity makes the CELP procedure desirable for many applications where bandwidth is at a premium, such as voice mail/storage, secure telephony and mobile telephony.

In some applications the CELP procedure will encounter channel errors. Efforts to minimize the effect of channel errors on speech compression procedures can be divided into methods which change the robustness of the source coder, by taking advantage of redundancies in the transmitted information, and methods which add error correction and/or error detection by means of a separate channel coder. Conventional implementations of the latter approach add a channel coder which maps selected bits of the quantization indices of a compression procedure into generic error-correction/detection codes which do not depend on the source. That this procedure is not optimal is suggested by the fact that the bits to be protected by the error correcting codes are hand picked, based on a judgement of their sensitivity. The separation between source and channel coders is justified if an arbitrarily complex coder-decoder design is optimized for a channel of a particular capacity (usually a worst case channel). Then the source coder rate can be matched to the capacity of this channel, resulting in suboptimal performance for channels of higher or lower capacity (or equal capacity, but with different characteristics). Speech coders usually encounter a variety of error conditions, and in many cases low error rates are prevalent. It is desirable to have a speech coder which exploits maximally the prevalent channels and decreases minimally in performance with diminishing channel capacity. To obtain this behavior, the source distortion must be considered in the design of the channel coder.

As an illustration that the source distortion should be considered in optimizing a channel code which is used in channels of various error rates, consider the example of Table 1. A four level scalar quantizer, of which each level has identical a-priori probability (no redundancy in the transmitted bit stream), is encoded with three different encoding schemes. Assume that virtually all channels are without errors, except a few in which a significant random error rate occurs. Table 1 shows the well known L1 and L2 error criteria for single bit errors (two bit errors per code word are exceedingly unlikely at low error rates) per codeword per error for the three encoding schemes. All codes are optimized for channels with zero error rate and have zero redundancy, but code 1 will result in the lowest L2 distortion, and code 1 and code 2 result in the lowest L1 distortion for noisy channels.

TABLE 1

| Four-Level Quantizer Example | | | |
|---|---|---|---|
| | code 1 | code 2 | code 3 |
| quantizer level | | | |
| 0.0 | 00 | 01 | 10 |
| 1.0 | 01 | 00 | 01 |
| 4.0 | 10 | 10 | 00 |
| 9.0 | 11 | 11 | 11 |
| error criterion | | | |
| L1 | 4.5 | 4.5 | 6.0 |
| L2 | 26.5 | 29.0 | 42.5 |

This example makes clear that a coder optimized for a certain channel (a channel with no bit errors in this case) can be further optimized to enhance performance for channels of lower quality by considering the source quality.

A technique known as pseudo-Gray coding, described in J-H. Chen, G. Davidson, A. Bersho, and K. Zeger, "Speech Coding for the Mobile Satellite Experiment", *Proc. IEEE Int. Conf. on Communications*, 756–763, (June 1987), is used to optimize the arrangement of a codebook to protect against the effects of channel errors. The Chen procedure takes as input a codebook and yields a rearrangement of the codevectors that minimizes the expected time average bit-error distortion. The utility of the Chen procedure is somewhat limited however because it does not include the effects of redundancy in the optimization. This is a serious limitation since in most applications where channel errors are at all significant, some redundancy is desirable despite the typically low bit rates, e.g., 4.8 kilobits per second. Furthermore, the Chen procedure uses a gradient optimization technique which involves iteratively switching the positions of codevectors to reduce the expected value of the bit-error distortion until a locally optimal state is reached. However, since the function being optimized typically has more than one local minimum, the Chen procedure will frequently result in sub-optimum performance.

In view of the foregoing, a recognized need exists in the art for an optimized, source dependent channel coder where the error protective effects of redundancy are included in the optimization and where the resulting code is more than locally optimal.

SOLUTION

This need is met and a technical advance is achieved in accordance with the principles of the invention in a parameter communication arrangement where a parameter that is transmitted over a channel using m-bit codewords or labels is quantized before transmission as one of only p levels, where, significantly, $p<k=2^m$. Since only p labels are needed to transmit the p levels, the unused k-p labels are advantageously available to provide redundancy. The receiver decodes the redundant labels in accordance with an error routine. An encoding table mapping from the p levels to p labels and a decoding table inverse mapping from the p labels to p levels are obtained using an optimization procedure to minimize the effect of channel errors. The optimization is based on the probability distribution for the p levels such that a relatively high proportion of the error protection made available by having redundant labels inures to the benefit of parameter levels which are more likely to be transmitted. The optimization procedure is a well known technique referred to as simulated annealing which is for the first time applied to source dependent channel coding and which provides a degree of randomness in the perturbation of labels which is gradually reduced to obtain a code which is globally optimum rather than only locally optimum. Since low bit rates are desirable in many applications, a degree of redundancy is afforded by having the number of quantized levels, p, between $2^{m-1}$ and $2^m$ in illustrative embodiments herein. The expense of such an arrangement in terms of transmitted bits is less than that of simple parity error detection.

A method in accordance with the invention is used to communicate a parameter from a source over a channel to a destination. The parameter is quantized at the source as one of p levels. The term quantization level as used herein refers to either a scalar quantization value, described by a single number, or a quantized vector value, described by an ordered set of numbers. The label that is transmitted over the channel is the one of p, m-bit labels that is associated with the quantized level in an encoding table defining a mapping from each of the p levels to a unique one of the p labels, where $p<k=2^m$. When the m-bit label received at the destination is one of the p labels, it is decoded as the level associated with that label in a decoding table defining the inverse of the encoding table mapping. When the received label is one of the k-p labels other than the p labels, it is decoded in accordance with an error routine. The mapping of the encoding table and the inverse mapping of the decoding table are obtained to minimize the effect of channel errors and are obtained using simulated annealing based on a probability distribution of the p levels for the parameter.

In one illustrative embodiment, the error routine comprises error correction and the received label is decoded as defined by an additional mapping of the decoding table from each of the k-p redundant labels. The encoding table mapping and the decoding table inverse and additional mappings are obtained concurrently as the result of a single, simulated annealing optimization.

In other illustrative embodiments, the error routine involves error detection and the substitution of another level, for example, a default level or a level based on information received over the channel other than the received label, e.g., the same level obtained from a previous communication of the parameter.

In a further illustrative embodiment, the error routine is a combination of the above error correction and error detection and substitution methods. Certain of the redundant labels are decoded using an additional mapping of the encoding table and the other redundant labels are decoded as substitute levels. The selections of which redundant labels result in error correction and which ones result in error detection and substitution are obtained as a result of the single, simulated annealing optimization.

In the exemplary embodiments herein, the parameter is obtained at the source by analyzing input speech in accordance with a code excited linear prediction (CELP) model; the result obtained by decoding the received label is used at the destination to generate synthetic speech also in accordance with the CELP model. Example parameters are the gain factors and indices for the adaptive and stochastic codebooks used in an illustrative CELP speech processing arrangement. The encoding table and decoding table mappings are obtained to minimize distortion in the synthetic speech generated at the destination.

Another alternative embodiment uses a single, simulated annealing procedure to obtain optimized encoding and decoding tables for each of a number of parameters, where the error measure used in the optimization is an overall error measure.

In accordance with another aspect of the invention, a parameter is quantized at the source as one of p levels. The label that is transmitted over the channel is the one of p, m-bit labels that is associated with the quantized level in an encoding table defining a mapping from each of the p levels to a unique one of the p labels, where $p<k=2^m$. When the m-bit label received at the destination is one of the p labels, it is decoded as the level associated with that label in a decoding table defining the inverse of the encoding table mapping. When the received label is one of the k-p labels other than the p labels, it is decoded in accordance with an error routine. When the received label is one of at least certain ones of the k-p other labels, it is decoded as defined by an additional mapping of the decoding table. The mapping of the encoding table and the inverse mapping of the decoding table are obtained to minimize the effect of channel errors and are obtained based on a probability distribution of the p levels for the parameter. The inverse and additional mappings are such that at least one of the p labels differs in b bits, $1<=b<m$, from a label which maps into the same level as the one of the p labels and which also differs in b bits from a label which maps into a level other than that same level.

In accordance with still another aspect of the invention, a parameter is quantized at the source as one of p levels. The label that is transmitted over the channel is the one of p, m-bit labels that is associated with the quantized level in an encoding table defining a mapping from each of the p levels to a unique one of the p labels, where $p<=k=2^m$. When the m-bit label received at the destination is one of the p labels, it is decoded as the level associated with that label in a decoding table defining the inverse of the encoding table mapping. The mapping of the encoding table and the inverse mapping of the decoding table are obtained to minimize the effect of channel errors using simulated annealing based on a probability distribution of the p levels for the parameter.

DRAWING DESCRIPTION

DETAILED DESCRIPTION

1. Introduction

Figure 1:
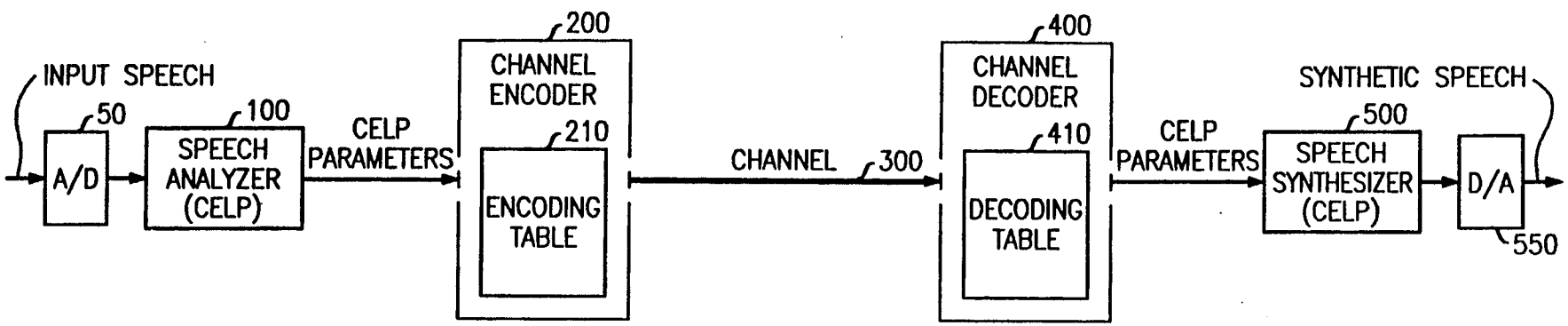
FIG. 1 is a block diagram of an exemplary speech coding arrangement using the channel coding method of the present invention.

An illustrative speech processing arrangement in accordance with the invention is shown in block diagram form in FIG. 1. Incoming analog speech signals are converted to digitized speech samples by an A/D converter 50. The digitized speech samples from converter 50 are processed by speech analyzer 100, which in the present example uses the CELP speech model for analysis. The results obtained by analyzer 100 are a number of parameters which are transmitted to a channel encoder 200 for encoding and transmission over a channel 300. Advantageously, channel 300 may be a communication transmission path or may be storage media so that voice synthesis may be provided for various applications at a later point in time. A channel decoder 400 receives the quantized parameters from channel 300, decodes them, and transmits the decoded parameters to a speech synthesizer 500. Synthesizer 500 processes the parameters using the CELP speech model to generate digital, synthetic speech samples which are in turn processed by a D/A converter 550 to reproduce the incoming analog speech signals. The present invention focuses on the channel encoding and decoding functions. An encoding table 210 within encoder 200 and a decoding table 410 within decoder 400 are obtained as the result of an optimization procedure referred to as simulated annealing to minimize the effect of channel errors in a manner described in detail herein.

In the present example, speech analyzer 100 and speech synthesizer 500 implement a particular CELP procedure referred to as stochastically excited linear prediction (SELP) as described in W. B. Kleijn, D. J. Krasinski, and R. H. Ketchum, "An Efficient Stochastically Excited Linear Predictive Coding Algorithm for High Quality Low Bit Rate Transmission of Speech", *Speech Communication*, Vol. VII, 305–316, 1988. The SELP procedure for speech coding offers good performance at bit rates as low as 4.8 kbit/s. Linear predictive coding (LPC) techniques remove the short-term correlation from the speech. A pitch loop removes long-term correlation, producing a noise-like residual, which is vector quantized. Parameters describing the LPC filter coefficients, the long-term predictor, and the vector quantization are obtained by analyzer 100. Several improvements to the SELP procedure are implemented which result in better speech quality and higher computational efficiency. In its closed-loop form, the pitch loop can be interpreted as a vector quantization of the desired excitation signal with an adaptive codebook populated by previous excitation sequences. To better model the non-stationarity of speech, the adaptive codebook is extended with a special set of candidate vectors which are transforms of other codebook entries. The second stage vector quantization is performed using a fixed stochastic codebook. In its original form, the SELP procedure requires a large computational effort. A recursive procedure is employed which performs a very fast search through the adaptive codebook. In this method, the error criterion is modified and th resulting symmetries are exploited. The same fast vector quantization procedure is applied to the stochastic codebook.

Figures 2, 3, 4, 5, 6:
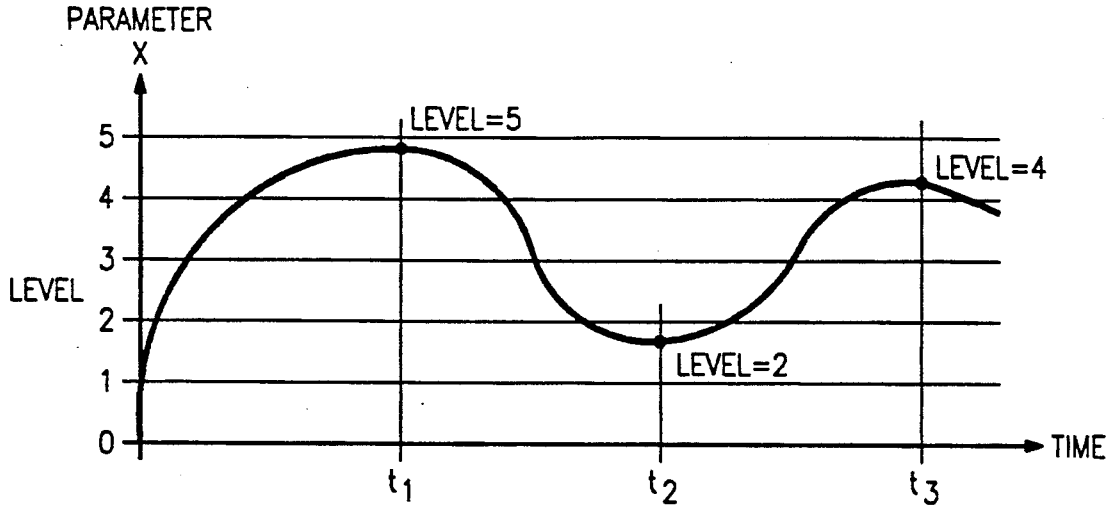
FIG. 2 illustrates the quantization of an arbitrary parameter X of the type generated by the speech analyzer of FIG. 1.
FIG. 3 is a probability distribution for the parameter X.
FIG. 4 is an encoding table mapping for parameter X as obtained from a simulated annealing optimization procedure and used in the channel encoder of FIG. 1.
FIG. 5 is a decoding table inverse mapping for parameter X as obtained from the simulated annealing procedure and used in the channel decoder of FIG. 1.
FIG. 6 is a decoding table additional mapping for parameter X as obtained from the simulated annealing procedure and used in the channel decoder of FIG. 1 for the case where error correction is performed on redundant labels.
Figure 7:
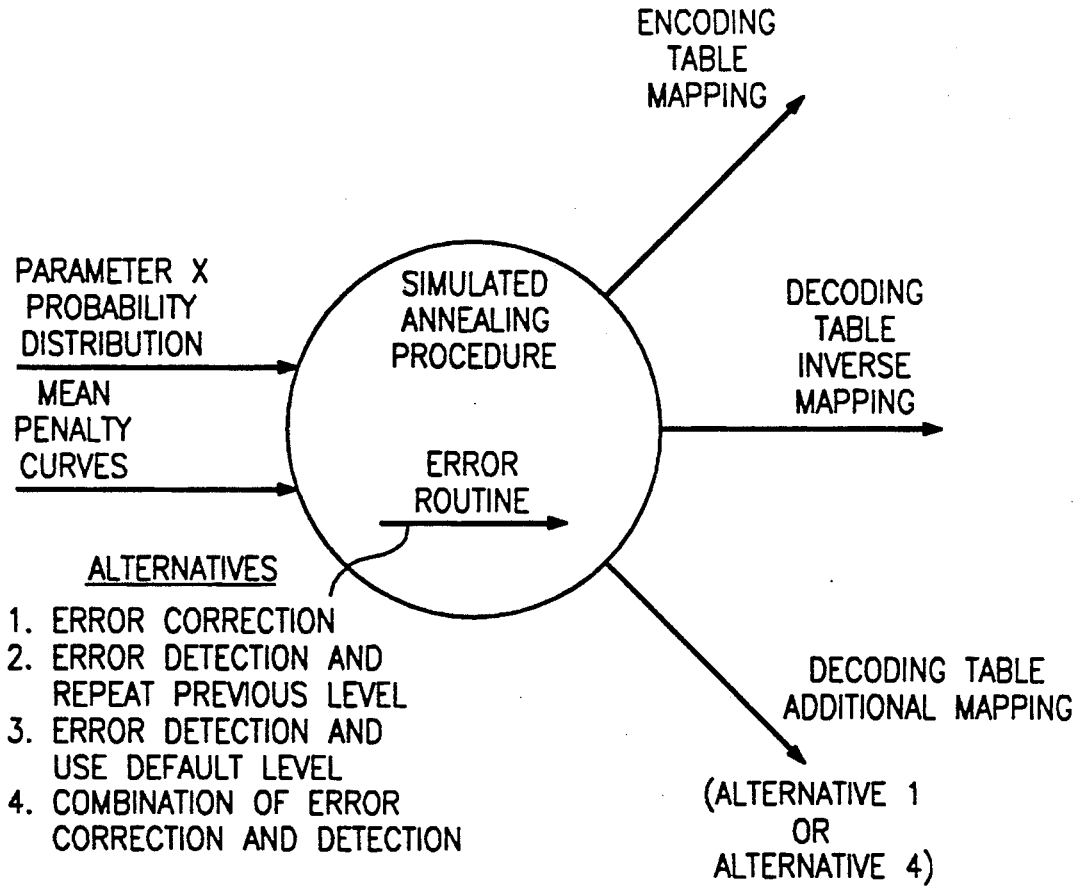
FIGS. 7 and 8 are diagrams depicting the inputs, outputs, and associated error routines for simulated annealing procedures for a single parameter and multiple parameters respectively, which procedures are described in detail with reference to Tables 2–4 herein.

As mentioned previously, this invention relates to optimized channel encoding and decoding of parameters such as the codebook indices and gain factors obtained by speech analyzer 100. FIG. 2 illustrates the quantization of an arbitrary parameter, X, as one of six levels 0, 1, 2, 3, 4, and 5. At time $t_1$, for example, X is quantized as level 5, at time $t_2$ as level 2, and at time $t_3$ as level 4. Since X is to be transmitted using a three-bit label and since only six of the possible eight labels are needed to transmit the six levels, two labels are available to provide redundancy. The probability distribution for parameter X is given in FIG. 3, where the levels 0, 1, 2, 3, 4, and 5 have finite probabilities, P(0), P(1), P(2), P(3), P(4), and P(5) and levels 6 and 7 each have zero probability. In a first exemplary embodiment, the redundant labels are used to provide error correction.. As functionally depicted in FIG. 7, the probability distribution of parameter X is provided as input to a simulated annealing procedure described in detail herein. The simulated annealing procedure produces as its output the mappings given for example by FIGS. 4, 5, and 6. FIG. 4 illustrates a particular mapping for parameter X in encoding table 210 where the levels 0, 1, 2, 3, 4, and 5 are mapped into the three-bit lables 010, 110, 111, 001, 000, and 100 respectively. FIG. 5 illustrates the inverse mapping for parameter X in decoding table 410 where the labels 010, 110, 111, 001, 000, and 100 are mapped back into the levels 0, 2, 3, 4, and 5 respectively. Since the error routine used in this first exemplary embodiment is error correction, an additional mapping as given by FIG. 6 is included in decoding table 410 for parameter X. When the labels 011 and 101 are received, channel decoder 400 knows that a channel error was made since the labels 011 and 101 are redundant and are not transmitted by encoder 200. The result of the simulated annealing procedure in this embodiment is that the label 011 is mapped into level 0 and the label 101 is mapped in level 5.

In a second exemplary embodiment, the error routine comprises error detection and the substitution of the level obtained during the previous communication of parameter X. In a third exemplary embodiment, the error routine comprises error detection and the substitution of a default level, e.g., level 0. In both the second and third embodiments, no additional mapping for parameter X is required in decoding table 410 like that of FIG. 6 when the error routine was error correction. However, the error routine operation when a redundant label is received is used in determining the error measure which is minimized by the simulated annealing optimization.

In a fourth exemplary embodiment, the error routine is a combination of the above error correction and error detection and substitution methods. Certain of the redundant labels, for example label 011 in the simple, three-bit label case described, are decoded using an additional mapping of the encoding table and the other redundant labels, label 101 in the example, are decoded as substitute levels. The selections of which redundant labels result in error correction and which ones result in error detection and substitution are obtained as a result of the single, simulated annealing optimization.

Figure 8:
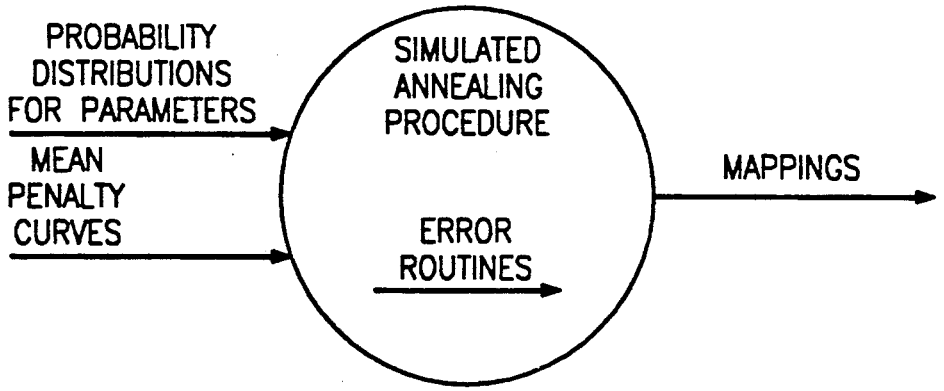

In a fifth exemplary embodiment, a single, simulated annealing procedure is used to obtain optimized encoding and decoding tables for each of a number of parameters as functionally depicted in FIG. 8, where the error measure used in the optimization is an overall error measure.

The next section describes in detail the method of measuring the immediate effect of decoding errors in the excitation function of CELP caused by channel errors. For reference purposes this section includes a brief description of the CELP procedure used. In section 3 a description of simulated annealing for the optimization of a source-dependent channel encoding is provided. The presented simulated annealing procedures are applicable to the coding of parameters of many (speech) compression procedures, but the focus here is their application to the CELP speech coding procedure. Section 4 studies the error sensitivity of the codebook gains. It applies the simulated annealing procedures to the channel coding of these parameters. In section 5 the focus shifts to the channel encoding of the codebook indices, to which the simulated annealing procedure is applied. Included with the discussion of the codebook indices is an example of the effect that the probability distribution has on the performance of the annealing procedures. This is followed by a conclusion section. Finally, several appendices with tables containing optimal codes for some of the CELP parameters are provided.

2. An Error Criterion for the Effect of Channel Errors on CELP 2.1. Description of the CELP Procedure The CELP procedure used here is identical to that described in W. B. Kleijn, D. J. Krasinski, and R. H. Ketchum, "An Efficient Stochastically Excited Linear Predictive Coding Algorithm for High Quality Low Bit Rate Transmission of Speech", *Speech Communication*, Vol. VII, 305-316, 1988. It efficiently encodes a digitized (usually sampled at a rate of 8000 Hz) speech signal on a frame by frame basis. Synthetic speech is generated by filtering an excitation signal. The filter adds the short term correlation to the signal, roughly modeling the effect of the vocal tract and the mouth. It is determined from a linear predictive (LP) analysis of the original speech signal. For transmission, the filter coefficients, are quantized with 35 bits using absolute line spectral frequencies (this method exhibits low sensitivity to channel errors). The ideal excitation signal segment which renders synthetic speech identical to the original speech for the present frame is vector quantized to facilitate transmission. The LP-analysis window length and the update intervals are 240 samples while a frame length of 60 samples is used for the vector quantization of the ideal excitation vector.

The target (or ideal) excitation vector for a frame, which results in a perfect match of the original speech (when it is filtered through the inverse LPC filter) is vector quantized, using a shape-gain vector quantizer, in two sequential stages. The candidate vectors of the two codebooks are selected to minimize a squared error criterion on the synthetic speech. Because of the finite size of a frame, the impulse response of the inverse LPC filter can be truncated and described by a finite impulse response (FIR) filter. The FIR filtering operation can be written as a matrix multiplication of a Toeplitz matrix H, which describes the filter, and a vector describing the excitation. If t is the target excitation vector, s the candidate excitation vector, and $\lambda$ the scaling of the excitation vector, then the mismatch of speech and synthetic speech is the vector $H(\lambda s-t)$. Thus, the error criterion to be minimized can be written as $(\lambda s-t)^T H^T H(\lambda s-t)$. The square matrix $H^T H$ is referred to as the spectral weighting matrix.

For the first stage an "adaptive" codebook is used which contains synthetic excitation functions of the recent past. It uses 4 bits for the gain and 7 or 8 bits for the index. The adaptive codebook is updated after each frame, and allows the excitation to become periodic in nature, facilitating the description of voiced speech. The second stage consists of a search through a fixed codebook, which further refines the excitation function resulting from the search through the adaptive codebook. The stochastic codebook consists of overlapping entries, with adjacent candidates separated by a shift of two samples. Its samples have a Gaussian distribution, center clipped at 1.5 standard deviation. Four bits are used for the gain and 8 bits for the indices. To improve the coding efficiency, the dynamic range of the stochastic codebook gain is reduced by multiplying the stochastic codebook by a scale factor prior to calculating the gain factor. The scale factor is based on energy of the contribution of the adaptive codebook to the present frame.

Thus, without error protection bits, the procedure used in the following sections requires 4233 or 4366 bits/second for a 7 or 8 bit adaptive codebook, respectively.

2.2. Definition of the Error Criterion

In this description, the effect of channel errors on the parameters describing the CELP excitation function and methods for performance improvement are discussed. To evaluate the performance of a CELP procedure under such conditions, an appropriate error criterion must be defined. A natural method would be to compare the signal to noise ratios (using the original speech as reference) of the synthetic speech with and without channel errors, or to compute the signal to noise ratio of the synthetic speech with channel errors using the synthetic speech without channel errors as reference. To evaluate the effect of channel errors on particular parameters, those parameters could be perturbed in a systematic way, while the other parameters are left untouched.

A difficulty with measuring the channel errors on synthetic speech which is corrupted by channel errors is that the result is dependent both on the size of the decoding error, and on the attenuation rate of the resulting distortion over the following frames. However, it may be argured that this method does provide a good measure of the overall channel error performance of a CELP procedure, provided that the errors are introduced such that they do not interfere with each other. Thus, one can evaluate the channel error performance of a particular encoding bit by systematically disturbing that bit in frames which are sufficiently far apart. (Note that at a 1% error rate the probability that the same parameter will be disturbed in adjacent frames is negligibly small. This can be expected to provide a better measure of the performance than perturbing the same bit in every successive frame, which may result in interaction of the errors in successive frames.

However, although systematically disturbing particular bits in frames sufficiently far apart may provide a satisfactory error criterion, it results in very laborious evaluations. This makes this error criterion unsuitable for the combinatorial optimization required to find a good channel code. Instead of using an evaluation criterion which operates on the output speech, including distortion over following frames, a criterion is introduced which maintains the features of the distance measure used in the CELP procedure to select the best candidate from the codebooks. By evaluating synthetic speech quality on a per frame basis the effect of the persistence of the distortion over time is eliminated.

The focus here will be on errors at low channel error rates (i.e. 1% or less); thus, it can safely be assumed that multiple bit errors are highly improbable in the description of a single parameter describing the CELP excitation. However, the following procedures are easily generalized to include more bit errors per parameter.

Let us define $c^{(i)}$ to be the channel code of a particular excitation parameter (codebook index or codebook gain), with quantization index i. The value or vector associated with the quantization index i is denoted as $r_{i,i}$. (The meaning of the double subscript will become clear later.) The probability that channel code $c^{(i)}$ occurs is denoted as $P(c^{(i)})$. Note that, in the case of no redundant codes, $P(c^{(i)})$ is the probability that index i provides the parameter with its best fit. The target (optimal) parameter or vector is denoted as t. At the analyzer t is matched by the quantized parameter $r_{i,i}$. In general, assume that $r_{i,i}$ can be the result of multiple quantizations; for example a vector may have a shape index as well as a gain index. If the quantization index is changed from the transmitted value i to j, then denote the resulting parameter or vector at the receive end by $r_{i,j}$. Thus, in the parameter $r_{i,j}$ the index i indicates that the other quantizations describing $r_{i,j}$ were associated with the index i and not with the received index j.

In this description the target t is always the target excitation vector for the particular codebook search. If the codebook candidate index is considered, then $r_{i,j}$ is the excitation shape vector of index j but with the gain properly quantized for the excitation vector i. If the codebook gain is considered, $r_{i,j}$ denotes the gain indexed j with the codebook index obtained from the search. Let us denote by $D_i(r_{i,j})$ the mean distance between the parameter $r_{i,j}$ and the target (optimal) value of the parameter t. Note that $D_i(r_{i,j})$ describes a function of j. That is, $D_i(r_{i,j})$ is a penalty function for changing the transmission index from i to j under the constraint that the quantization index i is associated with the parameter level or codebook entry of best fit. Further, N is the number of entries or levels, and M denotes the number of bits of a transmission label. An appropriate error criterion, which describes the sensitivity of the parameter encoding to single bit errors is now:

$$\epsilon = \sum_{i=0}^{N} P(c^{(i)}) \left[ \sum_{k=0}^{M} D_i(r_{i,f(c^{(i)},k)}) - D_i(r_{i,i}) \right], \tag{1}$$

where $f(c^{(i)},k)$ is the index of the parameter associated with the code word obtained by flipping the k'th bit of code word $c^{(i)}$. During optimization of the encodings {c}, one compares the criterion $\epsilon$ for various encoding configuration. Thus, the reference level $D_i(r_{i,i})$ is of no significance, and can be omitted from criterion (1).

The error criterion used in the codebook selection process of the CELP procedure cannot be used directly for the penalty function $D_i(\ )$ of equation (1) because the latter is a statistical average of the performance, while the former is evaluated for individual frames only. However, the CELP error criterion can be used as a starting point in the selection of a proper penalty function, which can be evaluated quickly. The selection process of the CELP procedure uses a least-squares error distance measure. The selection process will give identical results if the least-squares criterion is replaced by a signal to noise ratio, or its logarithm. This is important since the least-squares error criterion is not appropriate for averaging over a large number of frames; it weighs frames with large absolute error unduly heavily. To eliminate this problem, the mean logarithmic segmental signal to noise ratio is commonly used to evaluate the objective performance of the CELP and multipulse procedures. Thus, it is reasonable to choose $D_i(r_{i,j})$ to be the mean logarithmic segmental signal to noise ratio of the distorted speech signal generated with the parameter value or vector $r_{i,j}$.

The criterion used for the vector quantization of CELP is commonly modified to better model the perceived error. Due to masking, errors in spectral regions with high signal energy are less noticeable than errors in regions with lower signal energy. Thus, it is advantageous to change the penalty function D( ) similarly to put more emphasis on the spectral regions of lower energy. Here this type of weighting is used in the evaluation of the segmental signal to noise ratio. This can be expected to result in better perceived performance than a criterion which does not include this weighting. The CELP procedure already uses the weighting, facilitating usage of the modified criterion.

If the spectral weighting matrix $H^TH$ describes the effect of perceptual weighting, the distance measure $D_i(\ )$ for the codebook index (describing the unscaled excitation vector) becomes:

$$D_i(\lambda_k s_j) = E[10 \log ((\lambda_k s_j - t)^T H^T H (\lambda_k s_j - t)) - 10 \log (t^T H^T H t) | s_i] \tag{2}$$

where $s_j$ is the candidate vector associated with index j, which was substituted for the winning candidate vector $s_i$ due to a (single bit) channel error. $\lambda_k$ is the optimally quantized gain factor for $s_i$, and $E[.|s_i]$ indicates the expectation value under the condition that $s_i$ is the best match. The distance measure for the gain factor $\lambda$ looks similar:

$$D_i(\lambda_j s_k) = E[10 \log ((\lambda_j s_k - t)^T H^T H (\lambda_j s_k - t)) - 10 \log (t^T H^T H t) | \lambda_i] \tag{3}$$

where $\lambda_j$ is the gain quantization level associated with index j, which is substituted for the quantization level with index i due to a channel error. The quantization level $\lambda_i$ is the optimally quantized quantization for the winning codebook vector $s_k$. $E[.|\lambda_i]$ indicates the expectation value under the constraint that $\lambda_i$ is the best match. In the following, the expectation values will be approximated by the mean obtained over a large ensemble of frames.

Employing either equation (2) or (3), and a table which provides the values for the mean distance values $D_i(\ )$ and the probabilities $P(c^{(i)})$, the encoding of the parameters describing the excitation can be optimized with respect to the criterion of equation (1).

3. A Simulated Annealing Procedure to Optimize Channel Coding

The minimization of the criterion of equation (1) is a combinatorial optimization. Since it is usually impractical to evaluate the performance for all possible combinations of labels and indices, suboptimal techniques must be employed. A particularly powerful technique, which finds good solutions to a variety of combinatorial optimization problems, is simulated annealing, S. Kirkpatrick, C. D. Gelatt, M. P. Vecchi, "Optimization by Simulated Annealing", *Science*, Vol. 220, 671–680, 1983. It has also been used for the design of good source-independent channel codes, e.g., A. A. El Gamal, L. A. Hemachandra, I. Shperling, V. K. Wei, "Using Simulated Annealing to Design Good Codes", *IEEE Trans. Information Theory*, Vol. IT-33, No. 1, 116–123, 1987. Here the simulated annealing procedure is used to develop good source-dependent channel codes. Although the following procedures are easily generalized to include higher error rates, the focus here is to use the annealing procedures to improve the performance of the encoding of the excitation function of the CELP procedure at channel error rates of 1% and less at a minimal increase in the bit rate. As mentioned before, at these bit rates only single bit errors to the individual parameters have to be considered, since multiple bit errors are highly improbable. Furthermore, it is also reasonable to assume that the effect of interference between the errors can be neglected at these rates.

During the annealing process an error criterion $\epsilon$-the "energy" of the system- is minimized. This is achieved by lowering an abstract "temperature" T in steps while maintaining the system in equilibrium. At equilibrium, the system state is continuously changing, "traveling" through its phase space in such a manner that the probability of the system being in a certain state with energy $\epsilon_t$ at time t is proportional to the Boltzmann factor exp $(-\epsilon_t/T)$. Thus, the occurrences of the system states have a Boltzmann distribution. States with low energy (error) are more likely than states with high energy. However, at high temperature the distribution is more uniform than at low temperature. Because of the fact that the system has memory (it travels through phase space with small steps), lowering the temperature gradually causes the system to gravitate towards regions of high probability, i.e. wide and/or deep energy basins. The statistical behavior of the annealing process reduces significantly the probability of entrapment in local minima.

The stochastic motion through phase space is achieved by perturbing the system state in a directionally unbiased random manner to obtain a trial state with associated energy $\epsilon_{trial}$, and then accepting or rejecting the trial state as the next system state with probability one if $\epsilon_{trial}<\epsilon_t$, and probability exp $((\epsilon_t-\epsilon_{trial})/T)$ otherwise. It is easily verified that this indeed results in a Boltzmann distribution of the probabilities of the system states. If $\alpha$ is some factor slightly smaller than 1, the annealing procedure for optimization of channel codes is as given in Table 2.

TABLE 2

```
    get initial channel code {c^(j)}
    set initial temperature T
    while (criterion changes)
    do
        repeat until proper equilibrium is attained
            perturb channel code to create trial channel code
c           compute difference δ between error
c           criterion of trial and current channel code:
            δ = ε_trial − ε_orig
c           accept trial encoding if difference is < 0
            if(δ < 0)
                accept trial encoding
            endif
c           if difference is >0 accept trial encoding with
c           probability exp((ε_orig − ε_trial)/T):
            if(δ > 0)
                pick random number x, 0 < x < 1
```

TABLE 2-continued

```
                if(x < exp(−δ/T))
                    accept trial encoding
                else
                    reject trial encoding
                endif
            endif
        done
c       lower temperature
        T = αT
c       repeat equilibration above except if criterion does not
c           change for many iterations
        end do
```

For CELP, channel code perturbations can be generated by exchanging two randomly selected transmission labels (codes), i.e. two sequences exchange their transmission label, and compute the difference in the error criterion (1) before and after this change. The exchange of encodings is then preserved or undone depending on the probabilistic criterion.

Note that the transition probability from one channel code to another channel coder depends only on the difference of their error criteria. Thus, to minimize computer run time, the error criterion itself need not be evaluated during each iteration, but only the contributions which are modified by the label exchange. Since only single bit errors are considered, only sequences with transmission labels differing by a single bit from the exchanged labels are involved. When the labels of two sequences are exchanged, the distances of both sequences to all other sequences which have labels which differ by one bit from the labels of the two selected sequences must be considered in the computation. First the sum of these terms is computed for the original configuration, and then the same summation is performed for the trial configuration. If these partial energy evaluations are denoted by $\eta_{orig}$ and $\eta_{trial}$, the inner loop of the procedure is as given in Table 3.

TABLE 3

```
c       find two random transmission labels
        pick random label c^(p), 0 <= c^(p) < N
        pick random label c^(q), 0 <= c^(q) < N
c       compute the partial error criterion associated with
c       these two random labels and their neighbors (sum
c       penalty function between it and labels which
        differ by a single bit, and vice versa)
        η_orig = 0
        for k=0 to k=M−1
        do
            η_orig = η_orig + P(c^(p))D_p(τ_{p,f(c(p),k)}) +
            P(c^(f(c(p),k)))D_{f(c(p),k)}(τ_{f(c(p),k),p})
            η_orig = η_orig + P(c^(q))D_q(τ_{q,f(c(q),k)}) +
            P(c^(f(c(q),k)))D_{f(c(q),k)}(τ_{f(c(q),k),q})
        end do
c       perturb the code by exchanging the two transmission labels
        exchange c^(p) and c^(q)
c       compute again the partial error criterion associated
c       with these two random labels and their neighbors
        η_trial = 0
        for k=0 to k=M−1
        do
            η_trial = η_trial + P(c^(p))D_p(τ_{p,f(c(p),k)}) +
            P(c^(f(c(p),k)))D_{f(cp,k)}(τ_{f(c(p),k),p})
            η_trial = η_trial + P(c^(q))D_q(τ_{q,f(c(q),k)}) +
            P(c^(f(c(q),k)))D_{f(cq,k)}(τ_{f(c(q),k),q})
        end do
        δ = η_trial − η_orig
c       now use the annealing rules to decide if we accept the
c       perturbed code as the new code, or whether we stay
c       with the original one
c       compute difference δ between error
c       criterion of trial and current channel code:
        δ = η_trial−η_orig
c       accept trial encoding if difference is <0
```

TABLE 3-continued

```
        if (δ < 0)
                accept trial encoding
        endif
c       if difference is >0 accept trial encoding with
c       probability exp((η_orig − η_trial)/T):
        if(δ > 0)
                pick random number x, 0 < x < 1
                if(x < exp(−δ/T))
                        accept trial encoding
                else
                        reject trial encoding
                endif
        endif
```

The procedure of Table 3 was discussed for the case where no redundant labels are available for error-protection. The discussion is now generalized to include redundant labels if they are used for error detection (and not for error correction). If the simulated annealing procedure is used, error detection may cover an arbitrary fraction of all transmission errors (it will tend to select for detection those errors with the greatest impact on performance). If a label which is not associated with a parameter index (a redundant label) is obtained at the receive end of the CELP coder, an error is detected. Receive-end logic can be used to decide what value to assume for the affected parameter if an error is detected. In the present case this logic depends only on the fact that an error is detected, and does not use the fact that the erroneous code has a particular set of nearest neighbors. An example of such logic, which will be discussed in later sections, is repeating the previous adaptive codebook delay whenever an error is detected. Alternatively, one could select a default value for the parameter which contains an error. Given the receive-end logic, it is possible to find a value for the distance between the target parameter t, and the quantized parameter value substituted for it in the case of error detection. By using the expectation value of the resulting performance, the penalty function $D_i(\ )$ can be defined in its entirety for all original (non-redundant) labels. The transmission probability of the additional indices (and thus also the associated terms $P(c^{(i)})D_i(\ )$) is equal to zero. Therefore the function $D_i(\ )$ associated with these redundant labels is of no significance. If the set of transmission labels, which can be decoded without any additional logic, are thought of as being associated with quantization levels of finite probability, then the redundant labels are associated with quantization levels of zero probability (fictitious quantization levels). As a result the procedure of Table 3 can be used for the error detection case. The case where an optimal combination of error correction and error detection is used is discussed later herein.

The procedure can be efficiently implemented in software by using an ordered array of pointers indexed $c^{(i)}$ to structures associated with the parameters $r_i$. Thus, a pointer array index is the transmission label (code) $c^{(i)}$, while the structure it points to contains the parameter quantization index i, the label transmission probability $P(c^{(i)})$ and the entire distance function $D_i(r_{ij})$ as a function of j. In order to save some multiplications it is useful to normalize the distance function $D_i(\ )$ by premultiplying with the probability $P(c^{(i)})$. The exchange of labels is now easily implemented as the exchange of pointers. The penalty functions are obtained as follows: (1) determine the neighboring labels to $c^{(i)}$ (here those labels which differ from $c^{(i)}$ by one bit), (2) determine the quantization index associated with these neighboring labels (i.e. evaluate $f(c^{(i)},k)$ for all k), (3) look up $D_i(r_{i,f(c(i),k)})$ from the structure pointed to by $c^{(i)}$ and $D_{f(c(i),k)}(r_{f(c(i),k),i})$ from the structure pointed to by $c^{(f(c(i),k))}$.

Although in some cases it is advantageous to use error detection combined with a substitute parameter value from external (or previously transmitted) information, in many cases it is advantageous to use error correction. First the procedure is described for error correction only, and later the procedure is extended to obtain an optimal combination of both error correction and error detection.

The procedure for finding the best neighbors for the ensemble of transmitted transmission labels can be interpreted as a crude form of error correction. If redundant labels are added, this crude error correction can be improved upon by finding better neighbors for the ensemble of transmission labels. If there are a total of N labels, P of which have non-zero transmission probability, then the simulated annealing procedure must be augmented so that the N-P redundant labels can be shuffled between the P valid indices to quantized parameter levels. Thus, each quantization index i has one or more receive labels $c^{(i)}$ associated with it. One of these labels is the transmission label; this label has a finite $P(c^{(i)})$, while the other labels with the same index i have zero probability (this is why the probabilities have been associated with the transmission label, and not with the quantized parameter index i). Thus, each label is associated with an index and is either redundant or not. During the annealing process redundant labels can be distinguished from non-redundant labels by looking at the associated $P(c^{(i)})$ (or a separate "redundancy indicator" associated with the label). To perturb the redundant labels one changes the associated index at random to another valid index. This perturbation is performed by the procedure given in Table 4.

TABLE 4

```
c       find a random transmission label with zero probability
c       of transmission (i.e. a redundant label)
        pick random label c^(p),0<=c^(p)<N
        while (P(c^(p)) is not zero)
        do
                pick random integer c^(p),0<c^(p)<N
        end do
c       compute the partial error criterion associated with this
c       label (sum penalty function between it and labels which
c       differ by a single bit, and vice versa)
        η_orig = 0
        for k=0 to k=M−1
        do
                η_orig = η_orig + P(c^(f(c(p),k)))D_f(c(p),k)(r_f(c(p),k),p)
        end do
c       change the index associated with label we currently
c       considering by picking a random index and associating that
c       with the current label
        pick random integer m, 0<m<P
        replace the index p of redundant label c^(p) with m (i.e., c^(p)
        becomes c^(m))
c       compute again the partial error criterion associated with this
c       label and its neighbors
        η_trial = 0
        for k=0 to k=M−1
        do
                η_trial = η_trial + P(c^(f(c(m),k)))D_f(c(m),k)(r_f(c(m),k),p)
        end do
c       compute difference
c       criterion of trial and current code:
        δ = η_trial − η_orig
c       now use the annealing rules to decide if we accept the
c       perturbed code as the new code, or whether we stay with the
c       original one
c       accept trial encoding if difference is <0
```

TABLE 4-continued

```
    if(δ<0)
        accept trial encoding
    endif
c   if difference is >0 accept trial encoding with
c   probability exp((η_orig−η_trial)/T):
    if(δ>0)
        pick random number x, 0<x<1

        if(x<exp(−δ/T))
            accept trial encoding
        else
            reject trial encoding
        endif
    endif
```

This procedure of Table 4 can be added to the inner loop of the procedure to implement error correction of non-uniform accuracy for codes with error-protection bits. Its error correction capability is a function of the number of redundant labels.

The above procedure for (partial) error correction is extended to include error detection. Before, error detection capability was added by introducing fictitious quantization levels, which had zero transmission probability. The same method can be followed here, but now only a single fictitious quantization level is required. Any of the redundant labels can point towards this fictitious quantization level. Receival of such a redundant label would indicate a transmission error, triggering the procedure used when an error is detected (e.g. repeat the previous frame value). Note that the above design procedure results in an optimal trade-off between error correction and error detection.

Until now the procedures discussed assume that single parameters are to be encoded. However, the procedures readily generalize to include the channel encoding of several parameters at once, at the expense of a large increase of computational effort. The penalty functions $D_i(x_j)$, which originally described performance for all quantization levels $x_j$ of parameter x under the constraint that level $x_i$ was optimal, must now be generalized. Thus, for two parameters x and y, the penalty $D_{ik}(x_j, y_l)$, describes the performance for all combinations of quantization levels of the two parameters, under the constraint that the combination $x_i$, $y_k$ was obtained by the analyzer.

4. Reduction of the Effect of Channel Errors on the Gain Parameters

The gain parameters determine the energy of the speech signal. Errors in the gain transmission are usually heard as pops and clicks. Coders which do not have an inherent decay of gain errors will eventually overflow or underflow in an environment with channel errors. These problems can be minimized by increasing the attenuation rate of this type of distortion, and by minimizing the size of the decoding error according to the error criterion of equation (1).

4.1. Error Protection for the Codebook Gain Parameters

As mentioned in section 2.1 the CELP coder used to illustrate the techniques here uses 4 bits to transmit the adaptive codebook gain. Table 5 shows the quantization levels used for this gain, which have a large dynamic range, and their probabilities. To prevent adjustment of the error protection for silence, all data of this and the following sections were obtained from frames with a mean energy of amplitude 129 or more per sample. This resulted in a zero probability for the zero gain quantization level.

TABLE 5

Adaptive Codebook Gain Quantization Levels and Probabilities

| | | | | | | | | |
|---|---|---|---|---|---|---|---|---|
| level | −10.0 | −3.01 | −1.37 | −0.88 | −0.40 | 0.00 | 0.15 | 0.47 |
| probability | 0.0026 | 0.0090 | 0.0163 | 0.0333 | 0.0251 | 0.0000 | 0.0049 | 0.0518 |
| level | 0.69 | 0.88 | 1.03 | 1.32 | 2.08 | 4.51 | 14.9 | 20.0 |
| probability | 0.1097 | 0.1580 | 0.2566 | 0.2885 | 0.0379 | 0.0048 | 0.0011 | 0.0005 |

Figure 9:
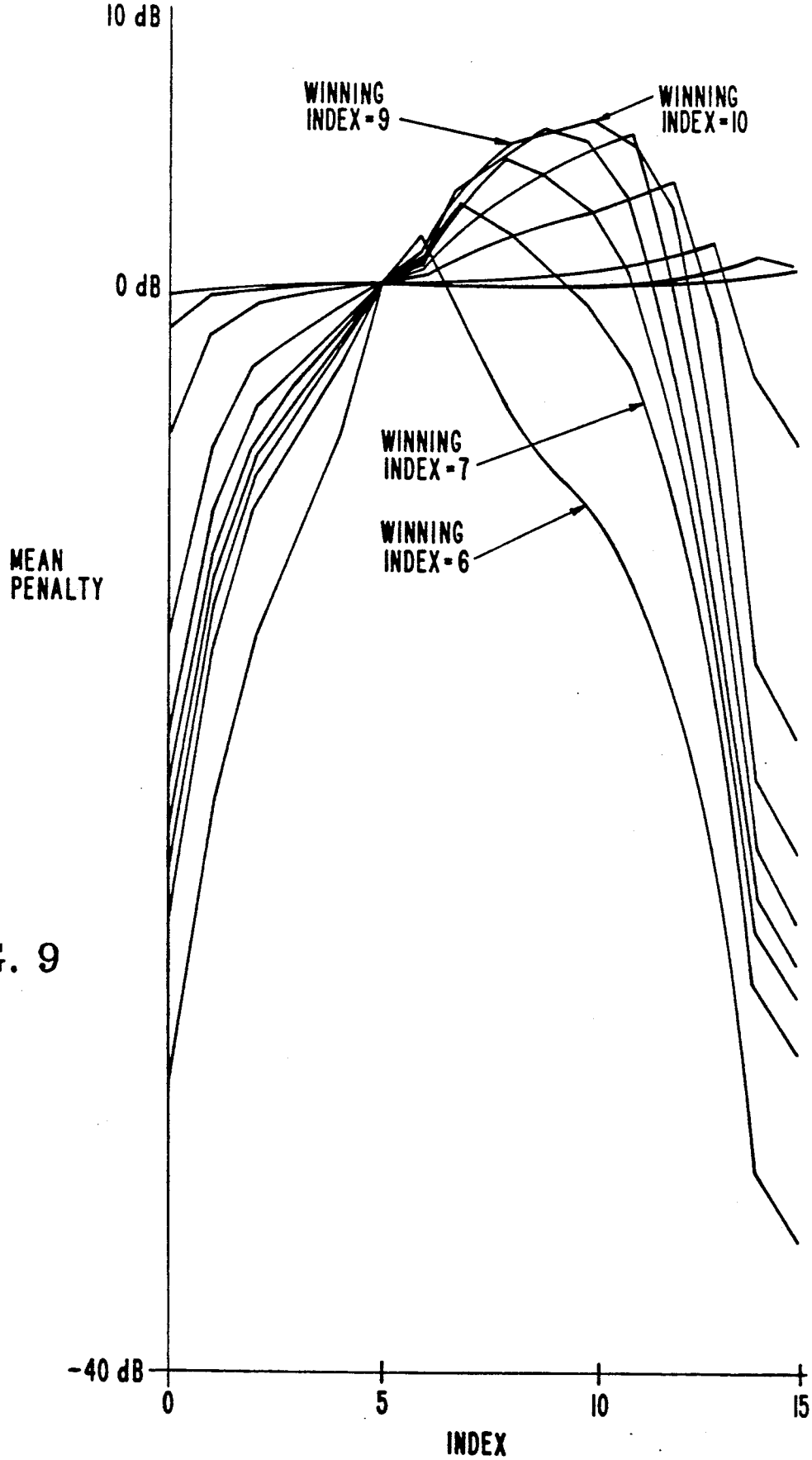
FIGS. 9 through 15 are data curves used in describing the performance of channel codes illustrating the present invention.

To improve the behavior of the gain factor under channel error conditions, the penalty functions $D_i(r_{i,j},t)$ must be known. The penalty functions for the indices 6 through 15 are approximated by averaging over a set of 19 speakers (19 sentences, 40 seconds of speech) are illustrated in FIG. 9. As expected, gains of small absolute value (which in case of channel errors are often replaced by larger gains) are most sensitive to errors, while large gains are less sensitive to errors.

In Table 6 the signal to noise ratios are shown for the adaptive codebook gain under channel error conditions for various encoding procedures, including a random code assignment, natural binary code (N.B.C.), and Gray code. Without the addition of any error-protection information the simulated annealing approach increases the performance by eliminating neighbors with large gains from the most likely gain levels, which are moderate in absolute magnitude. This is illustrated in Appendix A, which provides the coding tables for the annealing results, as well as a listing of all neighbors for each quantization level.

Table 6 includes an example where less than a single bit is used for protection. For this case the number of quantization levels is dropped from 16 to 12; the first four quantization levels (−10.0 through −0.79) were eliminated. This is consistent with the observation that the sign of the excitation pulses is usually preserved from one frame to the next. The large performance improvement from this four label redundancy is striking. It is associated with a minor clear channel performance reduction. It should be noted that the performance with four redundant labels is improved not only because of the redundant labels, but also because some of the allowed quantization levels which give large errors if erroneously selected have been eliminated. However, a relatively large performance improvement with a fractional bit allotment for error protection is typical of many examples which were informally studied.

Table 6 also displays the performance for a simple parity check with default logic. Using the error criterion of equation (1), the best default quantization level was found to be 0.88 (index 9), which scores an average signal to noise ratio of 3.91. Thus, this is the highest score to be obtained with a conventional parity check. (Here only default values which are part of the quantization table are considered). Using simulated annealing to obtain a good code at the same bit allocation resulted in better performance (4.55 dB). The coding table for this case, is provided in Appendix B, which, like Appendix A, displays the neighbors of all the quantization levels, showing clearly the improvement in similarity of quantization levels of codes which differ by one bit. The performance increased to 4.95 dB if two bits were expended on error correction. If three additional bits are used, complete error correction can be achieved for single bit errors. In this case the annealing method result is equivalent to a Hamming (7,4) code. Note, however, that multiple bit errors are more likely in a 7 bit code word than the original 4 bit code word, and that the table provides, therefore, a somewhat skewed view.

TABLE 6

Signal to Noise Ratios for the Adaptive Codebook Gain

| Method | Bits | Quantizer Levels | Redundant Labels | SSNR (clear channel,dB) | SSNR (one bit error,dB) |
|---|---|---|---|---|---|
| Random Code | 4 | 16 | 0 | 5.11 | −6.73 |
| N.B.C. | 4 | 16 | 0 | 5.11 | −4.14 |
| Gray Code | 4 | 16 | 0 | 5.11 | −0.838 |
| Annealing | 4 | 16 | 0 | 5.11 | 0.76 |
| Annealing | 4 | 12 | 4 | 5.05 | 3.41 |
| Parity with Default | 5 | 16 | 16 | 5.11 | 3.91 |
| Annealing | 5 | 16 | 16 | 5.11 | 4.55 |
| Annealing | 6 | 16 | 48 | 5.11 | 4.95 |
| Annealing/ Hamming | 7 | 16 | 112 | 5.11 | 5.11 |

The CELP coder uses 4 bits to describe the gain of the stochastic codebook. The 16 quantization levels for the gain, which are provided in Table 7 are symmetric since the stochastic codebook entries have no preferred orientation. Similarly the probability of occurrence of the various indices is also symmetric.

TABLE 7

Stochastic Codebook Gain Quantization Levels and Probabilities

| | | | | | | | | |
|---|---|---|---|---|---|---|---|---|
| level | −1.75 | −1.53 | −1.31 | −1.09 | −0.87 | −0.66 | −0.44 | −0.22 |
| probability | 0.0236 | 0.0152 | 0.0201 | 0.0286 | 0.0560 | 0.1027 | 0.1705 | 0.0743 |
| level | 0.22 | 0.44 | 0.66 | 0.87 | 1.09 | 1.31 | 1.53 | 1.75 |
| probability | 0.0789 | 0.1795 | 0.1102 | 0.0566 | 0.0295 | 0.0183 | 0.0139 | 0.0220 |

Figure 10:
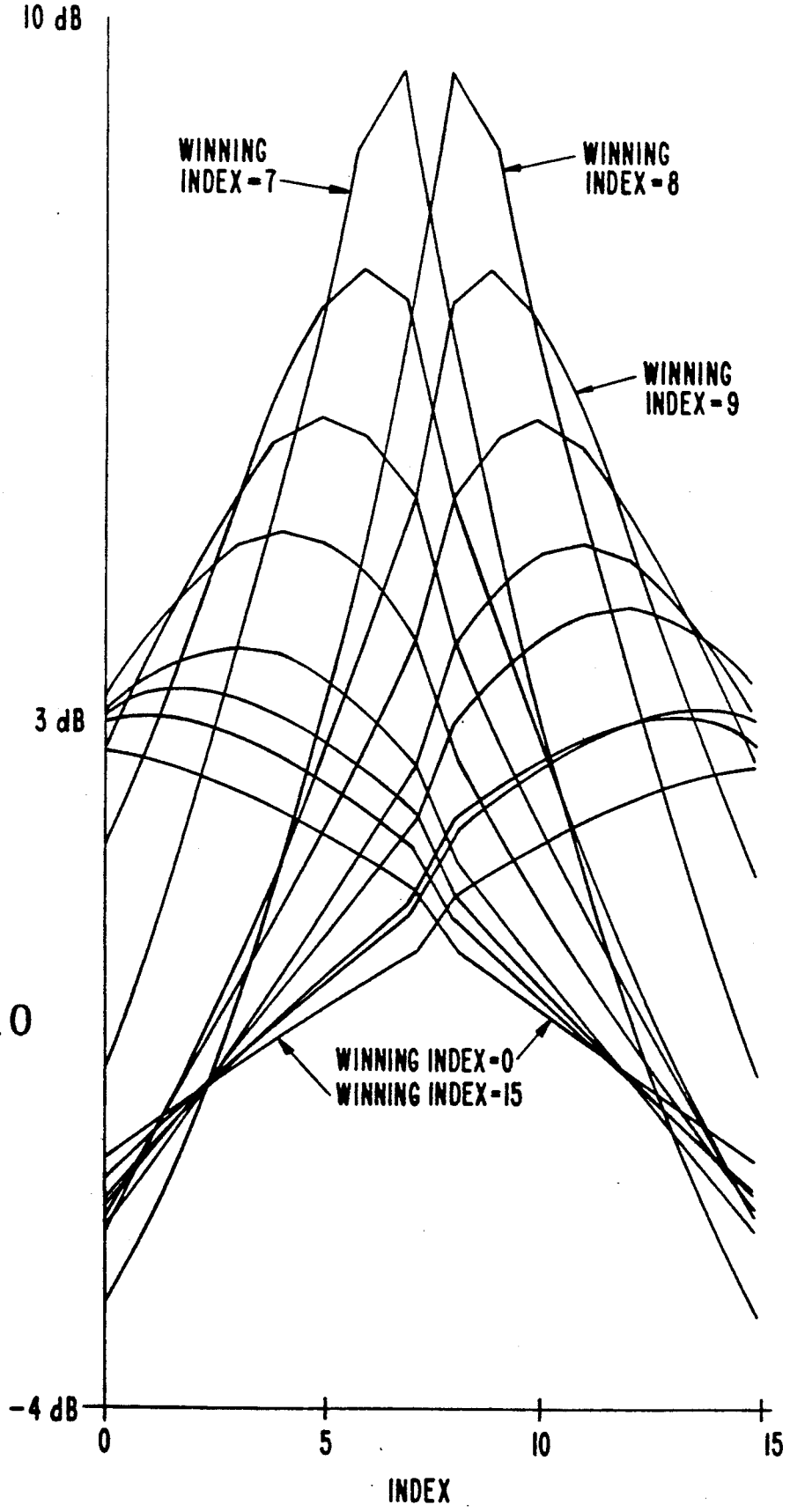

Because of the symmetry of the stochastic gain statistics, and its small dynamic range, their penalty functions $D_i(r_{ij})$ form a particularly good example. The entire set of 16 curves $D_i(\ )$ is provided in FIG. 10. Again, it shows that gains of small absolute value (which in case of an error are replaced by larger gains) are most sensitive to errors, while large gains are less sensitive to errors.

Table 8 shows the performance of the gain encoding for various encoding procedures under channel errors. The clear channel performance of the 16 level quantizer is 6.43 dB. Using a randomly selected gain from the 16 levels, as will occur in a the case of a single bit error for random coding, results in a worst case performance of approximately 2.75 dB. By using a Natural Binary Code (N.B.C.) the least significant bits of the transmitted code will have lower error sensitivity, resulting in a better performance. A Gray encoding of the gains will improve further on this. In fact, it turns out that the Gray encoding for this case is close to the best encoding found with the simulated annealing procedure. By removing the last four quantization levels, but keeping their four (now redundant) labels the annealing procedure can be used to further improve the performance under channel errors. The improvement is not as dramatic as in the case of the adaptive codebook gain because of the smaller dynamic range of the stochastic codebook. Again, this improvement does come at the expense of a minor degradation of clear channel performance.

Table 8 also shows the performance if one bit extra is allowed for error detection. The best default quantization level was −0.22 (index 8), which obtained a score of 5.02 dB. However, the annealing procedure used the same extra bit to define a code table with a score of 5.88 dB. In this case single bit errors become virtually inaudible.

TABLE 8

Average Signal to Noise Ratios for the Stochastic Codebook Gain

| Method | Bits | Quantizer Levels | Redundant Labels | SSNR (clear channel, dB) | SSNR (one bit error, dB) |
|---|---|---|---|---|---|
| Random Code | 4 | 16 | 0 | 6.43 | 2.74 |
| N.B.C. | 4 | 16 | 0 | 6.43 | 3.54 |
| Gray Code | 4 | 16 | 0 | 6.43 | 4.28 |
| Annealing | 4 | 16 | 0 | 6.43 | 4.51 |
| Annealing | 4 | 12 | 4 | 6.41 | 4.94 |
| Parity with Default | 5 | 16 | 16 | 6.43 | 5.02 |
| Annealing | 5 | 16 | 16 | 6.43 | 5.88 |
| Annealing | 6 | 16 | 48 | 6.43 | 6.31 |
| Annealing/ Hamming | 7 | 16 | 112 | 6.43 | 6.43 |

The results described in this section were obtained for the gain of the stochastic and adaptive codebooks of a particular implementation of the CELP procedure. However, generalization of the conclusions which are drawn from the results is expected for other CELP coders. This assertion is supported by the fact that the gain factors of the adaptive and stochastic codebook show similar behavior under channel errors, despite their different dynamic ranges and the differences in the characteristics of the two codebooks.

The actual level of protection required must be determined by considering the performance trade-off between clear channel performance, which decreases if additional information is to be transmitted, and performance under channel error conditions.

5. Reduction of the Effect of Channel Errors on Codebook Indices

The indices of the adaptive and stochastic codebooks determine the shape of their contributions to the CELP excitation function. Only the contribution of the adaptive codebook will be affected directly by past indexing errors. In frames where the adaptive codebook contribution is affected by previous indexing errors, the stochastic codebook contribution, which normally refines the synthetic speech waveform, will be anomalous. The net result is that voiced synthetic speech loses its periodic character and sounds scratchy. The rate of decay of this distortion is determined by the relative size of the contributions of the adaptive and stochastic codebooks. This rate could be increased by forcing the adaptive codebook contribution to be smaller. However, this is not desirable, since this decreases the periodic character of clear-channel speech.

Thus, it is not possible to increase the attenuation rate of the distortion generated by indexing errors without a detrimental effect on the clear channel performance. In the following sections the focus is on reducing the immediate effect of errors in the indices.

5.1. Results for the Adaptive Codebook Index

Figure 11:
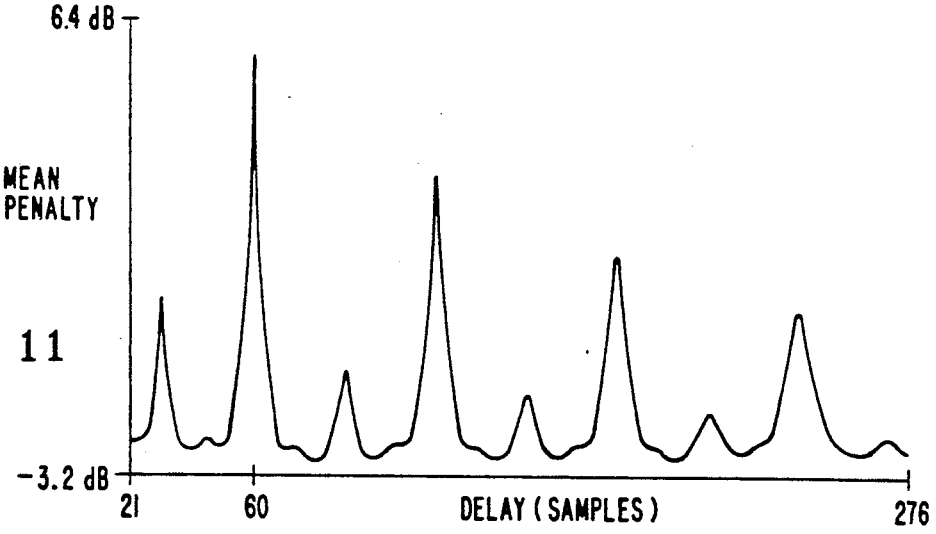

For the adaptive codebook index the behavior of the mean distance function $D_i(r_{ij},t)$ is dominated by the effects of the periodicity of the voiced speech signal. As an example, FIG. 11 shows the mean distance of the target vector to all candidate vectors in an 8 bit adaptive codebook, under the constraint that the target vector is best matched by the candidate vector starting 60 samples prior to the present frame ($D_{60}(r_{60,j})$ as function of j). In this case, candidate vectors with a delay of close to 30, 60, 90, 120 etc. (and in particular those with a delay of close to 60, 120, 180, 240) are preferred over other candidate vectors. A similar behavior is observed for other delays. These delays correspond to pitch halving and pitch doubling. Thus, if the actual delay is 60 samples a good channel code for this delay would, if it suffers a reversal of a single bit, result in the channel code for a delay near 30, 60, 90, 120, etc.

First the performance of the annealing procedure is considered under the assumption that all delays are equally likely. This assumption is not entirely reasonable but will provide useful information on how the simulated annealing procedure operates. Table 9 shows the performance of several encoding schemes for the adaptive codebook index under this assumption. The codes are compared over a set of 19 sentences from 19 speakers, representing approximately 40 seconds of speech. While the random code is worst, the Natural Binary Code (N.B.C) and the Gray code represent significant improvements. These improvements result since single bit reversals for the least significant bits are likely to result in a neighboring delay. The N.B.C. and Gray codes do not take advantage of the periodic nature of the adaptive codebook. This is in contrast with the simulated annealing procedure developed here, which is capable of taking advantage of this periodicity. However, since there are severe combinatorial constraints on the encoding of the various delays (note that each delay has seven neighbors for a seven bit code), this results in relatively small improvement.

TABLE 9

Average Signal to Noise Ratios for Various Index Schemes for the Adaptive Codebook (Uniform Weighting)

| Method | Bits | Delays | SSNR (clear channel) | SSNR (one bit error) |
|---|---|---|---|---|
| Random Code | 7 | 21-148 | 4.87 | −1.74 |
| N.B.C. | 7 | 21-148 | 4.87 | −0.60 |
| Gray Code | 7 | 21-148 | 4.87 | −0.25 |
| Annealing | 7 | 21-148 | 4.87 | −0.08 |
| Random Code | 8 | 21-276 | 4.73 | −1.93 |
| N.B.C. | 8 | 21-276 | 4.73 | −0.76 |
| Gray Code | 8 | 21-276 | 4.73 | −0.44 |
| Annealing | 8 | 21-276 | 4.73 | −0.25 |

Figure 12:
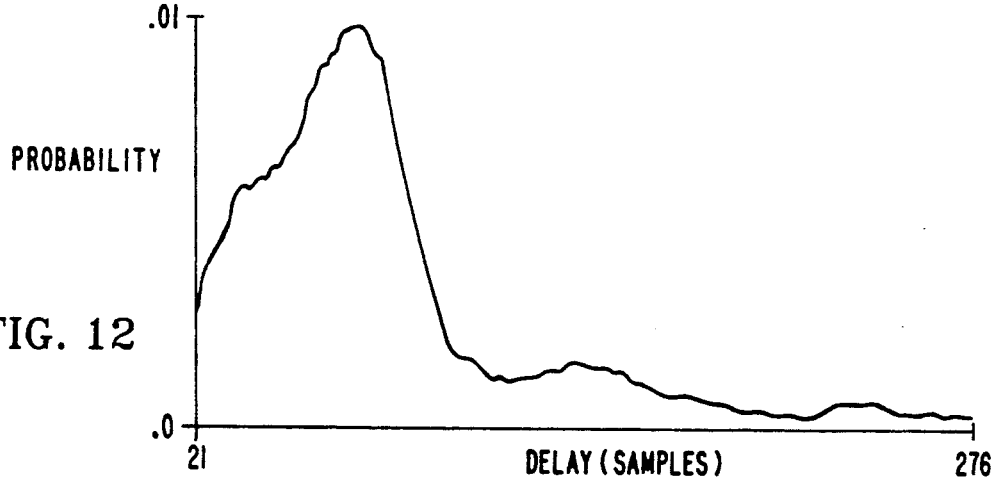

FIG. 12 shows a typical distribution for the observed delays. If this experimental probability distribution is used for the optimization of the channel coding, the effect of the forementioned constraint is reduced. Now delays of low probability will be saddled with dissimilar neighbors, while delays of high probability will have more similar neighbors. The performance for the various channel codes using the proper distribution is provided in Table 10. The clear channel performance is slightly different from that of Table 9. (The more likely delays are relatively short, resulting in a better performance when the probability distribution is taken into account.) The changes of the performance of the random code, the N.B.C. code, as well as the Gray Code are insignificant. However, the channel coding scheme obtained from the simulated annealing scheme shows an improvement of 0.4–0.5 dB because it emphasizes protection of transmission labels of high probability.

TABLE 10

Average Signal to Noise Ratios for Various Index Schemes for the Adaptive Codebook (Actual Weighting)

| Method | Bits | delays | SSNR (clear channel) | SSNR (one bit error) |
|---|---|---|---|---|
| Random Code | 7 | 21-148 | 5.09 | −1.76 |
| N.B.C. | 7 | 21-148 | 5.09 | −0.58 |
| Gray Code | 7 | 21-148 | 5.09 | −0.21 |
| Annealing | 7 | 21-148 | 5.09 | 0.32 |
| Random Code | 8 | 21-276 | 5.30 | −1.91 |
| N.B.C. | 8 | 21-276 | 5.30 | −0.77 |
| Gray Code | 8 | 21-276 | 5.30 | −0.43 |
| Annealing | 8 | 21-276 | 5.30 | 0.28 |

Figure 13:
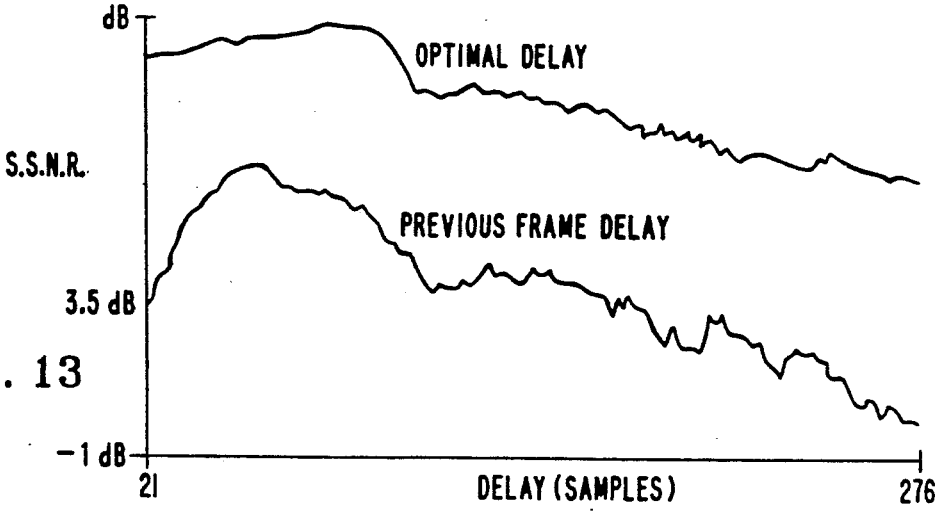

FIG. 13 shows the performance of the adaptive codebook as a function of delay, for the optimal case, and for the case that the delay of the previous frame is used in the present frame. Comparing FIG. 11 and FIG. 13 shows that for the case of a delay of 60 samples, repeating the previous frame delay provides significantly better performance than the mean performance of a random delay (within the range 21–276). In fact, for many delays repeating the previous delay is second in mean performance only to the present frame delay. The same result holds for other delays (more so for delays which most often represent a pitch). Thus, repeating the delay of the previous frame is a good strategy if errors can be detected. For example, a parity bit can be used to detect single bit errors in the adaptive codebook index. As is shown in Table 11, a 7 bit code, with an additional parity bit provides a significant improvement in performance under channel error conditions. The advantage of the simulated annealing procedure is that one can provide error detection on delays with high probability, but omit the detection on infrequently chosen delays, lowering the required bit allocation for protection to less than one bit. Note that the annealing procedure simultaneously optimizes the error detection and neighborliness of the codes for the indices. The results of this mixed detection and protection are shown in Table 11. Appendix C provides an example of a 7 bit adaptive codebook index channel coding with limited redundancy. Note that the simulated annealing procedure results in the same code as the parity code for the case where 128 delays are encoded with 8 bits.

TABLE 11

Average Signal to Noise Ratios for Various Redundant Index Schemes for the Adaptive Codebook

| Method | Bits | Delays | SSNR (clear channel) | SSNR (one bit error) |
|---|---|---|---|---|
| Annealing | 7 | 21-128 | 5.04 | 1.23 |
| Annealing | 7 | 21-118 | 5.01 | 1.71 |
| Annealing | 7 | 31-118 | 4.94 | 2.16 |

TABLE 11-continued

Average Signal to Noise Ratios for Various Redundant Index Schemes for the Adaptive Codebook

| Method | Bits | Delays | SSNR (clear channel) | SSNR (one bit error) |
|---|---|---|---|---|
| Annealing | 8 | 21-180 | 5.19 | 2.42 |
| Annealing/Parity | 8 | 21-148 | 5.09 | 2.93 |

5.2. Results for the Stochastic Codebook

Figure 14:
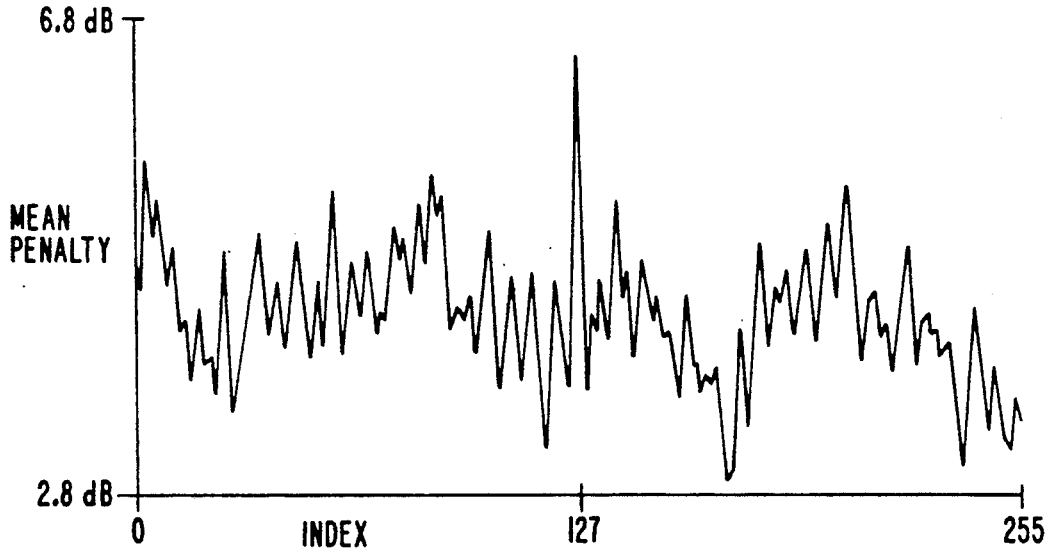
Figure 15:
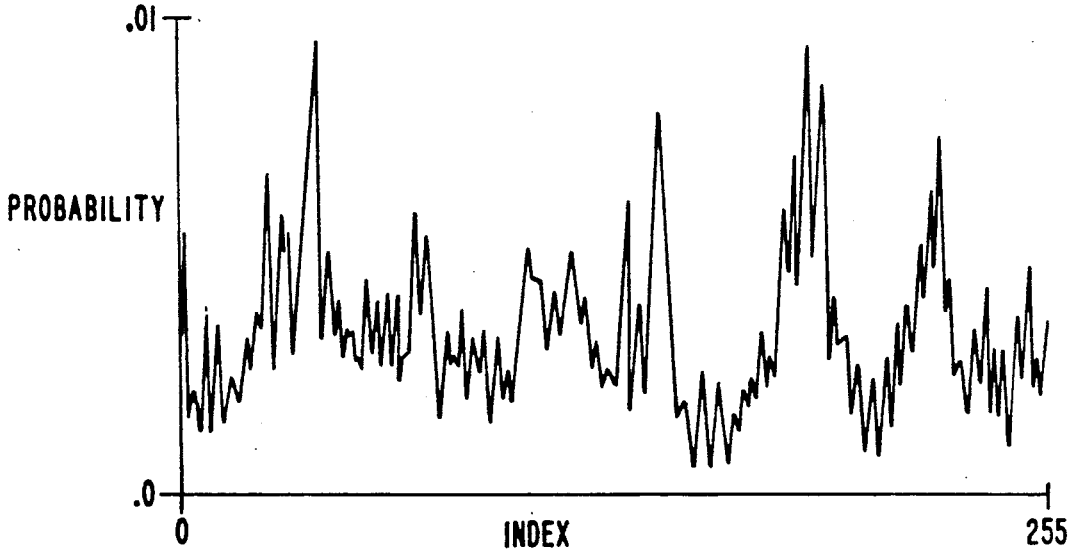

The behavior of the mean distance function $D_i(r_{ij})$ of the stochastic codebook does not show regularity like that of the adaptive codebook index. The mean distance of the candidate vectors to the target vector given that a certain sequence $(D_{127}(r_{127,j}))$ provides the best match is illustrated in FIG. 14. The only structure which is clear in this figure results from the overlapping nature of the stochastic codebook (neighboring candidates are shifted by two samples); direct neighbors are often preferred candidates for single bit reversals of the label. The same effect is also visible in the probability distribution (FIG. 15).

The procedures used for the adaptive codebook can also be used for channel coding of stochastic codebook. However, in this case the optimized channel code is dependent on the particular codebook, and code tables are therefore omitted. The difference between clear channel and one bit error performance is not as dramatic as for the adaptive codebook. The results are shown in Table 12. Because of the overlapping nature of the codebook Gray Code and Natural Binary Code perform better than the random labeling. Again, the simulated annealing procedure finds a better code than the other procedures. If error detection is present the performance of the code can be improved if the stochastic codebook contribution is omitted altogether in case of an error. If error detection is present for all bits, then the performance under error conditions will be identical to that of the optimal performance of the adaptive codebook.

TABLE 12

Average Signal to Noise Ratios for Various Index Schemes for an Overlapping Stochastic Codebook with a Skip of Two Samples between Adjacent Candidate Vectors

| Method | Bits | Indices | SSNR (clear channel) | SSNR (one bit error) |
|---|---|---|---|---|
| Random Code | 8 | 256 | 6.43 | 4.09 |
| Natural Binary Code | 8 | 256 | 6.43 | 4.23 |
| Gray Code | 8 | 256 | 6.43 | 4.39 |
| Annealing | 8 | 256 | 6.43 | 4.65 |
| Annealing/Parity | 9 | 256 | 6.43 | 5.09 |

6. Conclusion

Using the CELP procedure as example, it has been shown that source-dependent channel coding can be used to improve the performance of (speech) compression procedures operating in a range of channel error conditions.

To eliminate the effects of the feedback employed in many compression procedures, it is useful to divide the analysis of channel errors into the immediate effect of the decoding error and the attenuation rate of the resulting distortion. Usually, the immediate distortion can be described with a concise error criterion, which does not require reevaluation of the speech signal for each permutation of the channel code. Thus, it becomes computationally feasible to consider the source distortion in the optimization of the channel code.

This description focused on the channel encoding of the excitation function of the CELP procedure, and described an appropriate error criterion specific to the excitation function. Although not discussed here, it is straightforward to extend the source-dependent channel coding to the spectral parameters of the CELP procedure. In this case, well-known error criteria, such as the root mean square log spectral distance can be used as a measure of the immediate effect of channel errors. At greater design cost, the coding efficiency can be enhanced by channel encoding multiple parameters at once.

Optimization of the error criteria for source-dependent channel codes was achieved with simulated annealing. The proposed annealing procedures optimize the error criterion for a variety of conditions. Compared to conventional channel coding techniques, the new methods are advantageous in that they provide optimized error protection at any level of redundancy, including zero redundancy and a redundancy less than a full bit. The optimization results in weighted error correction and/or detection, with more probable codes receiving better protection. Optimal trade-off between error correction and detection is easily obtained. Although the description focused on single bit errors per parameter, the procedures can be generalized to include multiple bit errors per encoded parameter (this will require an estimate of the relative probabilities).

The general source-dependent channel codes obtained with the described optimization procedures are not constrained by the particular bit configurations of conventional error correction codes to obtain a certain robustness level. As a result, it is often practical to optimize the protection of the transmission parameters individually, or in small groups.

Usage of the described channel encoding and distortion attenuation techniques result in a CELP procedure with significantly reduced error sensitivity. This is confirmed by informal listening tests, which suggest that, with a bit rate increase of less than 100 bits per second, error rates below 0.1% are inaudible, while a 1% error rate results in minor distortion.

It is to be understood that the above-described embodiments are merely illustrative of the principles of the invention and that many variations may be devised by those skilled in the art without departing from the spirit and scope of the invention. It is therefore intended that such variations be included within the scope of the claims.

APPENDIX A

The following table provides the encoding of the adaptive codebook gain, for the case of no increase in bit rate. The indices of labels which differ by a single bit from the transmission labels (the neighbors) are also provided. Note that the most probable quantization levels do not have levels of large absolute values as neighbors.

| level | probability | label | index | neighbors |
|---|---|---|---|---|
| −10.000000 | 0.0026 | 9 | 0 | 12 5 3 14 |
| −3.010800 | 0.0090 | 5 | 1 | 7 2 14 3 |
| −1.366360 | 0.0163 | 7 | 2 | 8 1 15 4 |
| −0.798529 | 0.0333 | 13 | 3 | 9 4 0 1 |
| −0.395291 | 0.0251 | 15 | 4 | 10 3 5 2 |

-continued

| level | probability | label | index | neighbors |
|---|---|---|---|---|
| 0.000000 | 0.0000 | 11 | 5 | 11 0 4 15 |
| 0.145758 | 0.0049 | 2 | 6 | 15 13 8 11 |
| 0.467954 | 0.0518 | 4 | 7 | 1 8 13 9 |
| 0.691481 | 0.1097 | 6 | 8 | 2 7 6 10 |
| 0.878218 | 0.1580 | 12 | 9 | 3 10 12 7 |
| 1.034792 | 0.2566 | 14 | 10 | 4 9 11 8 |
| 1.324195 | 0.2885 | 10 | 11 | 5 12 10 6 |
| 2.082895 | 0.0379 | 8 | 12 | 0 11 9 13 |
| 4.514570 | 0.0048 | 0 | 13 | 14 6 7 12 |
| 14.853820 | 0.0011 | 1 | 14 | 13 15 1 0 |
| 20.000000 | 0.0005 | 3 | 15 | 6 14 2 5 |

APPENDIX B

The following table provides the encoding of the adaptive codebook gain, for the case of one additional bit per frame. The probability column indicates the probability at the CELP analyzer, labels which are not used for transmission are identified as "redundant". The indices of labels which differ by a single bit from the transmission labels (the neighbors) are also provided. Note that the most probable levels have good neighbors and that the redundant levels are all associated with highly probable indices.

| level | probability | label | index | neighbors | | | | |
|---|---|---|---|---|---|---|---|---|
| −10.000000 | 0.0026 | 14 | 0 | 9 | 8 | 10 | 9 | 11 |
| −3.010800 | 0.0090 | 25 | 1 | 11 | 10 | 8 | 7 | 9 |
| −1.366360 | 0.0163 | 1 | 2 | 3 | 10 | 8 | 9 | 7 |
| −0.798529 | 0.0333 | 0 | 3 | 2 | 3 | 4 | 5 | 6 |
| −0.395291 | 0.0251 | 4 | 4 | 8 | 9 | 3 | 8 | 7 |
| 0.000000 | 0.0000 | 8 | 5 | 9 | 10 | 8 | 3 | 11 |
| 0.145758 | 0.0049 | 16 | 6 | 7 | 11 | 7 | 11 | 3 |
| 0.467954 | 0.0518 | 21 | 7 | 7 | 9 | 7 | 8 | 8 |
| 0.691481 | 0.1097 | 13 | 8 | 8 | 9 | 9 | 8 | 8 |
| 0.878218 | 0.1580 | 7 | 9 | 9 | 8 | 10 | 9 | 9 |
| 1.034792 | 0.2566 | 11 | 10 | 10 | 9 | 9 | 10 | 10 |
| 1.324195 | 0.2885 | 26 | 11 | 10 | 11 | 11 | 11 | 10 |
| 2.082895 | 0.0379 | 22 | 12 | 9 | 7 | 11 | 11 | 9 |
| 4.514570 | 0.0048 | 31 | 13 | 11 | 8 | 10 | 9 | 9 |
| 14.853820 | 0.0011 | 19 | 14 | 11 | 7 | 9 | 10 | 10 |
| 20.000000 | 0.0005 | 28 | 15 | 8 | 11 | 11 | 7 | 8 |
| −0.798529 | redundant | 2 | 3 | 10 | 3 | 9 | 10 | 11 |
| −0.798529 | redundant | 17 | 7 | 6 | 14 | 7 | 1 | 2 |
| −0.798529 | redundant | 20 | 7 | 7 | 12 | 6 | 15 | 4 |
| −0.395291 | redundant | 5 | 8 | 4 | 9 | 2 | 8 | 7 |
| 0.145758 | redundant | 12 | 8 | 8 | 0 | 5 | 4 | 15 |
| 0.467954 | redundant | 29 | 8 | 15 | 13 | 1 | 7 | 8 |
| 0.878218 | redundant | 6 | 9 | 9 | 4 | 3 | 0 | 12 |
| 1.034792 | redundant | 9 | 9 | 5 | 10 | 8 | 2 | 1 |
| 1.034792 | redundant | 15 | 9 | 0 | 8 | 10 | 9 | 13 |
| 1.034792 | redundant | 23 | 9 | 12 | 7 | 14 | 13 | 9 |
| 1.034792 | redundant | 3 | 10 | 3 | 2 | 9 | 10 | 14 |
| 1.324195 | redundant | 10 | 10 | 10 | 5 | 0 | 3 | 11 |
| 1.324195 | redundant | 27 | 10 | 11 | 1 | 13 | 14 | 10 |
| 1.324195 | redundant | 18 | 11 | 14 | 6 | 12 | 11 | 3 |
| 1.324195 | redundant | 24 | 11 | 1 | 11 | 15 | 6 | 5 |
| 1.324195 | redundant | 30 | 11 | 13 | 15 | 11 | 12 | 0 |

APPENDIX C

Adaptive Codebook Encoding I

The following data were obtained for the adaptive codebook of a 240-60-35-7-4-8-4 (length of frame=240 samples, length of subframe=60 samples, 35 bits for LPC parameters, 7 bits for pitch delay, 4 bits for adaptive codebook gain, 8 bits for stochastic codebook index, 4 bits for stochastic codebook gain) procedure with the addition of 20 labels (only delays 21 through 128 are allowed at the transmitter). Seven-bit labels which do not occur in the transmission table are used to detect errors. They result in repetition of the previous delay, indicated as "rep". Note that generally delays of high probability are best protected, i.e. have repeats and/or related pitch values as neighbors.

| probability | label | delay | neighbors | | | | | | |
|---|---|---|---|---|---|---|---|---|---|
| 0.0013 | 18 | 21 | 25 | 114 | 112 | 40 | 65 | 92 | 22 |
| 0.0022 | 82 | 22 | 24 | 115 | 104 | 118 | rep | 91 | 21 |
| 0.0016 | 91 | 23 | 118 | 84 | 100 | 24 | rep | 45 | 41 |
| 0.0033 | 83 | 24 | 22 | 26 | 105 | 23 | 72 | 46 | 25 |
| 0.0024 | 19 | 25 | 21 | 27 | 107 | 41 | rep | 93 | 24 |
| 0.0038 | 81 | 26 | 115 | 24 | 52 | 84 | rep | 28 | 27 |
| 0.0051 | 17 | 27 | 114 | 25 | 106 | 42 | 80 | 30 | 26 |
| 0.0064 | 113 | 28 | 116 | 46 | 97 | 86 | 60 | 26 | 30 |
| 0.0097 | 32 | 29 | rep | rep | rep | rep | 31 | rep | 58 |
| 0.0104 | 49 | 30 | 31 | 93 | 96 | 43 | rep | 27 | 28 |
| 0.0099 | 48 | 31 | 30 | 92 | 32 | 89 | 29 | 114 | 116 |
| 0.0073 | 52 | 32 | 96 | 33 | 31 | 109 | rep | 113 | 98 |
| 0.0099 | 54 | 33 | 95 | 32 | 92 | 36 | 34 | 112 | 47 |
| 0.0167 | 38 | 34 | rep | rep | rep | rep | 33 | rep | rep |
| 0.0092 | 103 | 35 | rep | 62 | rep | rep | 48 | 70 | rep |
| 0.0093 | 62 | 36 | 110 | 109 | rep | 33 | rep | 37 | rep |
| 0.0108 | 30 | 37 | 111 | 38 | 40 | 112 | 74 | 36 | 101 |
| 0.0079 | 28 | 38 | rep | 37 | 39 | 113 | 76 | 109 | 102 |
| 0.0137 | 24 | 39 | 42 | 40 | 38 | 114 | 78 | 89 | 117 |
| 0.0126 | 26 | 40 | 41 | 39 | 37 | 21 | rep | rep | 118 |
| 0.0084 | 27 | 41 | 40 | 42 | 111 | 25 | 82 | 44 | 23 |
| 0.0095 | 25 | 42 | 39 | 41 | rep | 27 | 81 | 43 | 84 |
| 0.0066 | 57 | 43 | 89 | 44 | 108 | 30 | 85 | 42 | 86 |
| 0.0108 | 59 | 44 | rep | 43 | 110 | 93 | rep | 41 | 45 |
| 0.0064 | 123 | 45 | 90 | 86 | 49 | 46 | 66 | 23 | 44 |
| 0.0086 | 115 | 46 | 91 | 28 | 48 | 45 | rep | 24 | 93 |
| 0.0081 | 118 | 47 | 48 | 98 | 91 | rep | rep | 104 | 33 |
| 0.0055 | 119 | 48 | 47 | 97 | 46 | 49 | 35 | 105 | 95 |
| 0.0097 | 127 | 49 | rep | 50 | 45 | 48 | rep | 100 | 110 |
| 0.0077 | 125 | 50 | 99 | 49 | 86 | 97 | 63 | 51 | 108 |
| 0.0115 | 93 | 51 | 102 | 100 | 84 | 52 | rep | 50 | rep |
| 0.0082 | 85 | 52 | 103 | 105 | 26 | 51 | 53 | 97 | 106 |
| 0.0148 | 69 | 53 | rep | 70 | rep | rep | 52 | 62 | rep |
| 0.0128 | 74 | 54 | rep | rep | rep | rep | 118 | rep | rep |
| 0.0156 | 47 | 55 | rep | rep | rep | rep | 110 | rep | rep |
| 0.0148 | 42 | 56 | rep | rep | rep | rep | rep | rep | rep |
| 0.0141 | 64 | 57 | rep | rep | rep | rep | 115 | 58 | rep |
| 0.0114 | 96 | 58 | 60 | 59 | 61 | 87 | 116 | 57 | 29 |
| 0.0145 | 98 | 59 | rep | 58 | rep | rep | 91 | rep | rep |
| 0.0148 | 97 | 60 | 58 | rep | 62 | rep | 28 | rep | rep |
| 0.0134 | 100 | 61 | 62 | rep | 58 | rep | 98 | rep | rep |
| 0.0117 | 101 | 62 | 61 | 35 | 60 | 63 | 97 | 53 | 64 |
| 0.0132 | 109 | 63 | rep | rep | rep | 62 | 50 | rep | rep |
| 0.0145 | 37 | 64 | rep | rep | rep | rep | 96 | rep | 62 |
| 0.0161 | 2 | 65 | rep | rep | rep | rep | 21 | rep | rep |
| 0.0141 | 107 | 66 | rep | rep | rep | rep | 45 | rep | rep |
| 0.0154 | 110 | 67 | rep | rep | rep | rep | rep | rep | rep |
| 0.0170 | 79 | 68 | rep | rep | rep | 70 | 100 | rep | rep |
| 0.0147 | 70 | 69 | 70 | rep | rep | rep | 104 | rep | rep |
| 0.0161 | 71 | 70 | 69 | 53 | 72 | 68 | 105 | 35 | 71 |
| 0.0216 | 7 | 71 | rep | rep | rep | rep | 107 | rep | 70 |
| 0.0165 | 67 | 72 | rep | rep | 70 | rep | 24 | rep | rep |
| 0.0169 | 44 | 73 | rep | rep | rep | rep | 109 | 76 | rep |
| 0.0251 | 14 | 74 | rep | 76 | rep | rep | 37 | rep | rep |
| 0.0202 | 4 | 75 | rep | rep | rep | 76 | 113 | rep | rep |
| 0.0196 | 12 | 76 | 79 | 74 | 78 | 75 | 38 | 73 | 77 |
| 0.0181 | 76 | 77 | rep | rep | rep | rep | 102 | rep | 76 |
| 0.0176 | 8 | 78 | 81 | rep | 76 | rep | 39 | rep | rep |
| 0.0253 | 13 | 79 | 76 | rep | 81 | rep | rep | rep | rep |
| 0.0174 | 1 | 80 | rep | rep | rep | 81 | 27 | rep | rep |
| 0.0159 | 9 | 81 | 78 | 82 | 79 | 80 | 42 | 85 | 83 |
| 0.0154 | 11 | 82 | rep | 81 | rep | rep | 41 | rep | rep |
| 0.0143 | 73 | 83 | rep | rep | rep | rep | 84 | rep | 81 |
| 0.0112 | 89 | 84 | 117 | 23 | 51 | 26 | 83 | 86 | 42 |
| 0.0125 | 41 | 85 | rep | rep | rep | rep | 43 | 81 | rep |
| 0.0139 | 121 | 86 | 88 | 45 | 50 | 28 | rep | 84 | 43 |
| 0.0121 | 104 | 87 | rep | rep | rep | 58 | 88 | rep | rep |
| 0.0115 | 120 | 88 | 86 | 90 | 99 | 116 | 87 | 117 | 89 |
| 0.0121 | 56 | 89 | 43 | rep | 109 | 31 | rep | 39 | 88 |
| 0.0126 | 122 | 90 | 45 | 88 | rep | 91 | rep | 118 | rep |
| 0.0104 | 114 | 91 | 46 | 116 | 47 | 90 | 59 | 22 | 92 |
| 0.0106 | 50 | 92 | 93 | 31 | 33 | rep | rep | 21 | 91 |
| 0.0108 | 51 | 93 | 92 | 30 | 95 | 44 | 94 | 25 | 46 |
| 0.0108 | 35 | 94 | rep | rep | rep | rep | 93 | rep | rep |

-continued

| probability | label | delay | neighbors | | | | | | |
|---|---|---|---|---|---|---|---|---|---|
| 0.0064 | 55 | 95 | 33 | 96 | 93 | 110 | rep | 107 | 48 |
| 0.0060 | 53 | 96 | 32 | 95 | 30 | 108 | 64 | 106 | 97 |
| 0.0060 | 117 | 97 | 98 | 48 | 28 | 50 | 62 | 52 | 96 |
| 0.0051 | 116 | 98 | 97 | 47 | 116 | 99 | 61 | 103 | 32 |
| 0.0053 | 124 | 99 | 50 | rep | 88 | 98 | rep | 102 | 109 |
| 0.0042 | 95 | 100 | 101 | 51 | 23 | 105 | 68 | 49 | 111 |
| 0.0066 | 94 | 101 | 100 | 102 | 118 | 104 | rep | rep | 37 |
| 0.0059 | 92 | 102 | 51 | 101 | 117 | 103 | 77 | 99 | 38 |
| 0.0068 | 84 | 103 | 52 | 104 | 115 | 102 | rep | 98 | 113 |
| 0.0044 | 86 | 104 | 105 | 103 | 22 | 101 | 69 | 47 | 112 |
| 0.0049 | 87 | 105 | 104 | 52 | 24 | 100 | 70 | 48 | 107 |
| 0.0046 | 21 | 106 | 113 | 107 | 27 | rep | rep | 96 | 52 |
| 0.0051 | 23 | 107 | 112 | 106 | 25 | 111 | 71 | 95 | 105 |
| 0.0044 | 61 | 108 | 109 | 110 | 43 | 96 | rep | rep | 50 |
| 0.0046 | 60 | 109 | 108 | 36 | 89 | 32 | 73 | 38 | 99 |
| 0.0024 | 63 | 110 | 36 | 108 | 44 | 95 | 55 | 111 | 49 |
| 0.0035 | 31 | 111 | 37 | rep | 41 | 107 | rep | 110 | 100 |
| 0.0049 | 22 | 112 | 107 | 113 | 21 | 37 | rep | 33 | 104 |
| 0.0037 | 20 | 113 | 106 | 112 | 114 | 38 | 75 | 32 | 103 |
| 0.0027 | 16 | 114 | 27 | 21 | 113 | 39 | rep | 31 | 115 |
| 0.0037 | 80 | 115 | 26 | 22 | 103 | 117 | 57 | 116 | 114 |
| 0.0029 | 112 | 116 | 28 | 91 | 98 | 88 | 58 | 115 | 31 |
| 0.0040 | 88 | 117 | 84 | 118 | 102 | 115 | rep | 88 | 39 |
| 0.0055 | 90 | 118 | 23 | 117 | 101 | 22 | 54 | 90 | 40 |

APPENDIX D

Adaptive Codebook Encoding II

The following data were obtained for the adaptive codebook of a 240-60-35-8-4-8-4 (length of frame=240 samples, length of subframe=60 samples, 35 bits for LPC parameters, 8 bits for pitch delay, 4 bits for adaptive codebook gain, 8 bits for stochastic codebook index, 4 bits for stochastic codebook gain) procedure with the addition of 76 labels (only delays 21 through 180 are allowed at the transmitter). As in Appendix B, labels which do not occur in the transmission table are used to detect errors, resulting in the repetition of the previous delay, indicated as "rep". Since a repeat is usually a good substitute for the actual delay value, the most likely delays generally have repeats as their closest neighbors.

| probability | label | delay | neighbors |
|---|---|---|---|
| 0.0046 | 17 | 21 | rep rep 157 168 129 rep 22 24 |
| 0.0050 | 81 | 22 | 160 108 111 167 130 102 21 23 |
| 0.0053 | 209 | 23 | 26 141 rep rep rep rep 24 22 |
| 0.0060 | 145 | 24 | 25 176 126 135 131 96 23 21 |
| 0.0062 | 144 | 25 | 24 89 rep 137 rep rep 26 rep |
| 0.0062 | 208 | 26 | 23 180 27 138 51 52 25 160 |
| 0.0063 | 212 | 27 | rep rep 26 rep rep rep rep rep |
| 0.0064 | 166 | 28 | rep rep rep rep rep rep rep rep |
| 0.0066 | 237 | 29 | rep 145 rep rep rep rep rep rep |
| 0.0067 | 106 | 30 | rep rep rep rep rep rep rep rep |
| 0.0070 | 202 | 31 | rep rep rep rep rep rep rep rep |
| 0.0072 | 33 | 32 | rep rep rep rep rep 129 rep rep |
| 0.0075 | 222 | 33 | rep rep rep rep rep rep rep rep |
| 0.0077 | 204 | 34 | rep rep rep rep rep rep rep rep |
| 0.0079 | 246 | 35 | 36 rep rep rep rep rep rep rep |
| 0.0081 | 247 | 36 | 35 97 107 37 144 142 178 109 |
| 0.0081 | 255 | 37 | rep rep rep 36 145 rep 153 rep |
| 0.0082 | 30 | 38 | 114 rep rep rep rep rep rep rep |
| 0.0081 | 226 | 39 | rep rep rep rep rep rep rep rep |
| 0.0080 | 116 | 40 | rep rep rep rep rep rep rep rep |
| 0.0081 | 34 | 41 | rep rep rep rep rep rep rep rep |
| 0.0079 | 102 | 42 | rep rep rep rep rep rep rep rep |
| 0.0082 | 40 | 43 | rep rep rep rep rep rep rep rep |
| 0.0080 | 163 | 44 | rep rep rep rep 177 174 rep rep |
| 0.0082 | 12 | 45 | rep rep rep rep rep rep rep rep |
| 0.0084 | 160 | 46 | rep rep rep rep rep rep rep rep |
| 0.0086 | 108 | 47 | rep rep rep rep rep rep rep rep |

-continued

| probability | label | delay | neighbors |
|---|---|---|---|
| 0.0086 | 238 | 48 | 145 rep rep rep rep rep rep rep |
| 0.0087 | 172 | 49 | rep rep rep rep rep rep rep rep |
| 0.0089 | 101 | 50 | rep rep rep rep rep rep rep rep |
| 0.0091 | 192 | 51 | rep rep rep rep 26 rep rep rep |
| 0.0093 | 240 | 52 | rep rep rep rep rep 26 rep rep |
| 0.0094 | 114 | 53 | 105 rep rep rep rep rep rep rep |
| 0.0095 | 60 | 54 | 161 rep rep rep rep rep rep rep |
| 0.0098 | 86 | 55 | 110 rep rep rep rep rep rep rep |
| 0.0100 | 36 | 56 | rep rep rep rep rep rep rep rep |
| 0.0104 | 66 | 57 | rep rep rep rep rep rep rep rep |
| 0.0107 | 6 | 58 | 116 rep rep rep rep rep rep rep |
| 0.0109 | 54 | 59 | 118 rep rep rep rep rep rep rep |
| 0.0111 | 225 | 60 | rep rep rep rep rep rep rep rep |
| 0.0114 | 232 | 61 | rep rep rep rep rep rep rep rep |
| 0.0118 | 142 | 62 | 123 rep rep rep rep rep rep rep |
| 0.0117 | 105 | 63 | rep rep rep rep rep rep rep rep |
| 0.0122 | 132 | 64 | 127 rep rep rep rep rep rep rep |
| 0.0123 | 0 | 65 | 129 rep rep rep rep rep rep rep |
| 0.0124 | 201 | 66 | rep rep rep rep rep rep 132 rep |
| 0.0126 | 46 | 67 | rep rep rep rep rep rep rep rep |
| 0.0130 | 48 | 68 | rep rep rep rep rep rep rep rep |
| 0.0133 | 184 | 69 | rep rep rep rep rep 137 rep rep |
| 0.0134 | 228 | 70 | rep rep rep rep rep rep rep rep |
| 0.0134 | 250 | 71 | rep rep rep rep rep rep rep rep |
| 0.0134 | 235 | 72 | rep rep 145 rep rep rep rep rep |
| 0.0135 | 198 | 73 | 146 rep rep rep rep rep rep rep |
| 0.0136 | 72 | 74 | rep rep rep rep rep rep rep rep |
| 0.0135 | 78 | 75 | 150 rep rep rep rep rep rep rep |
| 0.0134 | 96 | 76 | rep rep rep rep rep rep rep rep |
| 0.0132 | 190 | 77 | 153 rep rep rep rep rep rep rep |
| 0.0130 | 170 | 78 | rep rep rep rep rep rep rep rep |
| 0.0127 | 20 | 79 | 157 rep rep rep rep rep rep rep |
| 0.0126 | 45 | 80 | rep rep rep rep 161 rep rep rep |
| 0.0123 | 125 | 81 | rep rep rep rep rep 163 161 rep |
| 0.0120 | 92 | 82 | 163 rep rep rep rep rep rep rep |
| 0.0117 | 252 | 83 | rep rep rep rep rep rep rep rep |
| 0.0112 | 58 | 84 | rep rep rep rep rep rep rep rep |
| 0.0107 | 10 | 85 | 171 rep rep rep rep rep rep rep |
| 0.0104 | 43 | 86 | rep rep rep rep rep 171 rep rep |
| 0.0099 | 130 | 87 | 174 rep rep rep 89 rep rep rep |
| 0.0092 | 18 | 88 | rep rep rep rep rep rep rep 89 |
| 0.0085 | 146 | 89 | 176 25 91 175 87 90 180 88 |
| 0.0080 | 178 | 90 | 177 rep rep rep rep 89 rep rep |
| 0.0077 | 150 | 91 | 179 rep 89 rep rep rep rep rep |
| 0.0074 | 126 | 92 | rep rep rep rep rep rep rep rep |
| 0.0070 | 120 | 93 | rep rep rep rep rep rep rep rep |
| 0.0067 | 249 | 94 | rep rep rep rep rep rep rep rep |
| 0.0064 | 169 | 95 | rep rep rep rep rep 132 rep rep |
| 0.0062 | 177 | 96 | rep 177 98 rep rep 24 rep rep |
| 0.0059 | 245 | 97 | rep 36 rep rep rep rep 98 rep |
| 0.0055 | 181 | 98 | 99 178 96 154 100 126 97 158 |
| 0.0054 | 180 | 99 | 98 rep rep rep rep rep rep rep |
| 0.0051 | 165 | 100 | rep rep rep rep 98 127 rep rep |
| 0.0049 | 68 | 101 | rep rep rep rep rep rep rep rep |
| 0.0046 | 113 | 102 | rep 105 rep rep rep 22 rep rep |
| 0.0044 | 123 | 103 | rep rep rep 105 rep 166 rep rep |
| 0.0041 | 99 | 104 | rep rep rep rep 105 rep rep rep |
| 0.0038 | 115 | 105 | 53 102 109 103 104 108 106 107 |
| 0.0037 | 51 | 106 | rep rep 118 rep rep rep 105 177 |
| 0.0036 | 243 | 107 | rep rep 36 rep rep 141 177 105 |
| 0.0036 | 83 | 108 | rep 22 110 166 rep 105 rep 141 |
| 0.0036 | 119 | 109 | rep rep 105 rep rep 110 118 36 |
| 0.0036 | 87 | 110 | 55 111 108 112 149 109 117 142 |
| 0.0035 | 85 | 111 | rep 110 22 163 rep rep 157 rep |
| 0.0033 | 95 | 112 | rep 163 166 110 150 rep 114 rep |
| 0.0032 | 63 | 113 | rep 161 rep 118 rep 114 rep 153 |
| 0.0031 | 31 | 114 | 38 162 169 117 115 113 112 122 |
| 0.0031 | 15 | 115 | rep rep 171 116 114 rep 150 123 |
| 0.0030 | 7 | 116 | 58 156 173 115 117 119 149 120 |
| 0.0029 | 23 | 117 | rep 157 rep 114 116 118 110 179 |
| 0.0029 | 55 | 118 | 59 158 106 113 119 117 109 178 |
| 0.0029 | 39 | 119 | rep rep rep rep 118 116 rep rep |
| 0.0029 | 135 | 120 | rep 127 174 123 179 rep 146 116 |
| 0.0027 | 156 | 121 | 124 rep 137 rep rep rep rep rep |
| 0.0027 | 159 | 122 | rep 124 170 179 123 153 rep 114 |
| 0.0027 | 143 | 123 | 62 128 172 120 122 152 147 115 |
| 0.0028 | 157 | 124 | 121 122 135 126 128 154 125 162 |
| 0.0028 | 221 | 125 | rep rep rep rep rep rep 124 163 |
| 0.0029 | 149 | 126 | rep 179 24 124 127 98 rep 157 |
| 0.0029 | 133 | 127 | 64 120 131 128 126 100 148 156 |
| 0.0029 | 141 | 128 | rep 123 132 127 124 rep rep rep |

-continued

| probability | label | delay | neighbors |
|---|---|---|---|
| 0.0029 | 1 | 129 | 65 173 156 133 21 32 130 131 |
| 0.0030 | 65 | 130 | rep rep rep rep 22 rep 129 rep |
| 0.0030 | 129 | 131 | rep 174 127 132 24 rep rep 129 |
| 0.0031 | 137 | 132 | 134 172 128 131 135 95 66 133 |
| 0.0032 | 9 | 133 | rep 171 rep 129 168 rep rep 132 |
| 0.0033 | 136 | 134 | 132 rep rep rep 137 rep rep rep |
| 0.0032 | 153 | 135 | 137 170 124 24 132 rep rep 168 |
| 0.0033 | 24 | 136 | 168 rep rep rep rep rep rep 137 |
| 0.0033 | 152 | 137 | 135 175 121 25 134 69 138 136 |
| 0.0033 | 216 | 138 | rep rep rep 26 rep rep 137 rep |
| 0.0033 | 219 | 139 | rep rep rep 141 rep rep 170 166 |
| 0.0033 | 195 | 140 | rep rep 146 rep 141 rep 174 rep |
| 0.0034 | 211 | 141 | 180 23 142 139 140 107 176 108 |
| 0.0034 | 215 | 142 | rep rep 141 rep 146 36 179 110 |
| 0.0034 | 111 | 143 | rep rep rep rep rep 150 rep 145 |
| 0.0033 | 231 | 144 | rep rep rep 145 36 146 rep rep |
| 0.0034 | 239 | 145 | 48 29 72 144 37 147 152 143 |
| 0.0034 | 199 | 146 | 73 148 140 147 142 144 120 149 |
| 0.0035 | 207 | 147 | rep rep rep 146 rep 145 123 150 |
| 0.0035 | 197 | 148 | rep 146 rep rep rep rep 127 rep |
| 0.0034 | 71 | 149 | rep rep rep 150 110 rep 116 146 |
| 0.0034 | 79 | 150 | 75 151 164 149 112 143 115 147 |
| 0.0033 | 77 | 151 | rep 150 rep rep 163 rep rep rep |
| 0.0033 | 175 | 152 | rep rep rep rep 153 123 145 rep |
| 0.0033 | 191 | 153 | 77 154 155 178 152 122 37 113 |
| 0.0033 | 189 | 154 | rep 153 rep 98 rep 124 rep 161 |
| 0.0033 | 187 | 155 | rep rep 153 177 rep 170 rep rep |
| 0.0033 | 5 | 156 | rep 116 129 rep 157 rep rep 127 |
| 0.0033 | 21 | 157 | 79 117 21 162 156 158 111 126 |
| 0.0033 | 53 | 158 | rep 118 rep 161 rep 157 rep 98 |
| 0.0032 | 57 | 159 | rep rep 161 rep rep 168 rep rep |
| 0.0033 | 80 | 160 | 22 rep rep rep rep rep rep 26 |
| 0.0033 | 61 | 161 | 54 113 159 158 80 162 81 154 |
| 0.0033 | 29 | 162 | rep 114 168 157 rep 161 163 124 |
| 0.0033 | 93 | 163 | 82 112 167 111 151 81 162 125 |
| 0.0031 | 75 | 164 | rep rep 150 rep 166 rep 171 rep |
| 0.0031 | 90 | 165 | 166 rep rep rep rep rep rep rep |
| 0.0030 | 91 | 166 | 165 167 112 108 164 103 169 139 |
| 0.0028 | 89 | 167 | rep 166 163 22 rep rep 168 rep |
| 0.0027 | 25 | 168 | 136 169 162 21 133 159 167 135 |
| 0.0028 | 27 | 169 | rep 168 114 rep 171 rep 166 170 |
| 0.0028 | 155 | 170 | 175 135 122 176 172 155 139 169 |
| 0.0028 | 11 | 171 | 85 133 115 173 169 86 164 172 |
| 0.0028 | 139 | 172 | rep 132 123 174 170 rep rep 171 |
| 0.0028 | 3 | 173 | rep 129 116 171 rep rep rep 174 |
| 0.0028 | 131 | 174 | 87 131 120 172 176 44 140 173 |
| 0.0027 | 154 | 175 | 170 137 rep 89 rep rep rep rep |
| 0.0027 | 147 | 176 | 89 24 179 170 174 177 141 rep |
| 0.0027 | 179 | 177 | 90 96 178 155 44 176 107 106 |
| 0.0027 | 183 | 178 | rep 98 177 153 rep 179 36 118 |
| 0.0027 | 151 | 179 | 91 126 176 122 120 178 142 117 |
| 0.0026 | 210 | 180 | 141 26 rep rep rep rep 89 rep |

I claim:

1. Speech processing apparatus comprising speech analyzer means responsive to input speech signals from a source of input speech signals for generating a plurality of parameter signals representing said input speech signals in accordance with a speech model, at least one of said parameter signals being quantized as one of p levels, channel encoder means comprising encoder memory means for storing an encoding table defining a mapping from each of said p levels to a unique one of p, m-bit label signals, where $p<k=2^m$, and means responsive to said speech analyzer means for transmitting, over a channel to a destination, the one of said p label signals that is associated with said one of said p levels in said encoding table, channel decoder means comprising decoder memory means for storing a decoding table defining the inverse of said encoding table mapping and means, responsive to a label signal received at said destination from said channel, for decoding said received label signal as the one of said p levels associated with said received label signal in said decoding table inverse mapping when said received label signal is one of said p label signals, and for decoding said received label signal in accordance with an error routine when said received label signal is one of the k-p, m-bit label signals other than said p label signals, and speech synthesizer means responsive to said decoding means for synthesizing speech based at least in part on said decoded label signal, wherein said encoding table mapping stored by said encoder memory means and said decoding table inverse mapping stored by said decoder memory means are obtained to minimize the effect of channel errors and are obtained using simulated annealing based on a probability distribution of said p levels for said one parameter signal.

2. Speech processing apparatus in accordance with claim 1 wherein said encoder memory means further stores other mappings and said decoder memory means further stores other inverse mappings, said other mappings and said other inverse mappings being for use in communication of other parameter signals from said source over said channel to said destination, said other mappings and said other inverse mappings being obtained, concurrently with said encoding table mapping and said decoding table inverse mapping, using said simulated annealing.

3. Speech processing apparatus in accordance with claim 2 wherein said simulated annealing minimizes an overall error measure for said one parameter signal and said other parameter signals.

4. Speech processing apparatus in accordance with claim 1 wherein said decoding table stored by said decoder memory means defines an additional mapping from each of said k-p label signals, said decoding means decodes said received label signal in accordance with said additional mapping when said received label signal is one of said k-p label signals, and said decoding table additional mapping is also obtained using said simulated annealing to minimize the effect of channel errors based on said probability distribution.

5. Speech processing apparatus in accordance with claim 4 wherein said inverse and additional mappings are obtained concurrently using said simulated annealing.

6. Speech processing apparatus in accordance with claim 1 wherein said decoding means decodes said received label signal as a default level when said received label signal is one of said k-p label signals.

7. Speech processing apparatus in accordance with claim 1 wherein said decoding means decodes said received label signal based on information received over said channel other than said received label signal when said received label signal is one of said k-p label signals.

8. Speech processing apparatus in accordance with claim 1 wherein said decoding means decodes said received label signal as the same level that was obtained from a previous communication of said one parameter signal over said channel when said received label signal is one of said k-p label signals.

9. Speech processing apparatus in accordance with claim 1 said decoding table stored by said decoder memory means defines an additional mapping from each of certain ones of said k-p label signals, said decoding means decodes said received label signal in accordance with said additional mapping when said received label signal is one of said certain ones of said k-p label signals, and said decoding means decodes said received label signal as a default level when said received label signal is one of said k-p label signals other said certain ones.

10. Speech processing apparatus in accordance with claim 1 said decoding table stored by said decoder memory means defines an additional mapping from each of certain ones of said k-p label signals, said decoding means decodes said received label signal in accordance with said additional mapping when said received label signal is one of said certain ones of said k-p label signals, and said decoding means decodes said received label signal based on information received over said channel other than said received label signal when said received label signal is one of said k-p label signals other said certain ones.

11. Speech processing apparatus in accordance with claim 1 said decoding table stored by said decoder memory means defines an additional mapping from each of certain ones of said k-p label signals, said decoding means decodes said received label signal in accordance with said additional mapping when said received label signal is one of said certain ones of said k-p label signals, and said decoding means decodes said received label signal as the same level that was obtained from a previous communication of said one parameter signal over said channel when said received label signal is one of said k-p label signals other said certain ones.

12. Speech processing apparatus in accordance with claim 1 wherein said p label signals are selected from k, m-bit label signals as a result of said simulated annealing.

13. Speech processing apparatus in accordance with claim 1 wherein said model is a code excited linear prediction model.

14. Speech processing apparatus in accordance with claim 1 wherein said encoding table mapping and said decoding table mapping are obtained to minimize distortion in said synthesized speech.

15. Speech processing apparatus in accordance with claim 1 wherein $p>2^{m-1}$.

16. Speech processing apparatus comprising speech analyzer means responsive to input speech signals from a source of input speech signals for generating a plurality of parameter signals representing said input speech signals in accordance with a speech model, at least one of said parameter signals being quantized as one of p levels, channel encoder means comprising encoder memory means for storing an encoding table defining a mapping from each of said p levels to a unique one of p, m-bit label signals, where $p<k=2^m$, and means responsive to said speech analyzer means for transmitting, over a channel to a destination, the one of said p label signals that is associated with said one of said p levels in said encoding table, channel decoder means comprising decoder memory means for storing a decoding table defining the inverse of said encoding table mapping and defining an additional mapping from each of certain ones of the k-p, m-bit label signals other than said p label signals and means, responsive to a label signal received at said destination from said channel, for decoding said received label signal as the one of said p levels associated with said received label signal in said decoding table inverse mapping when said received label signal is one of said p label signals, and for decoding said received label signal as defined by said additional mapping when said received label signal is one of said certain ones of said k-p label signals, and speech synthesizer means responsive to said decoding means for synthesizing speech based at least in part on said decoded label signal, wherein said encoding table mapping stored by said encoder memory means and said decoding table inverse mapping stored by said decoder memory means are obtained to minimize the effect of channel errors and are obtained based on a probability distribution of said p levels for said one parameter signal, wherein said inverse and additional mappings are such that at least one of said p label signals differs in b bits, $1<=b<m$, from a label signal which maps into the same level as said at least one of said p label signals and which also differs in b bits from a label signal which maps into a level other than said same level.

17. Speech processing apparatus in accordance with claim 16 wherein said decoding means decodes said received label signal as a default level when said received label signal is one of said k-p label signals other than said certain ones.

18. Speech processing apparatus in accordance with claim 16 wherein said decoding means decodes said received label signal based on information received over said channel other than said received label signal when said received label signal is one of said k-p label signals other than said certain ones.

19. Speech processing apparatus in accordance with claim 16 wherein said decoding means decodes said received label signal as the same level that was obtained from a previous communication of said one parameter signal over said channel when said received label signal is one of said k-p label signals other than said certain ones.

20. Speech processing apparatus in accordance with claim 16 where $p>2^{m-1}$.

21. Speech processing apparatus in accordance with claim 16 wherein said model is a code excited linear prediction model.

22. Speech processing apparatus in accordance with claim 16 wherein said encoding table mapping and said decoding table mapping are obtained to minimize distortion in said synthesized speech.

23. Speech processing apparatus comprising speech analyzer means responsive to input speech signals from a source of input speech signals for generating a plurality of parameter signals representing said input speech signals in accordance with a speech model, at least one of said parameter signals being quantized as one of p levels, channel encoder means comprising encoder memory means for storing an encoding table defining a mapping from each of said p levels to a unique one of p, m-bit label signals, where $p<=k=2^m$, and means responsive to said speech analyzer means for transmitting, over a channel to a destination, the one of said p label signals that is associated with said one of said p levels in said encoding table, channel decoder means comprising decoder memory means for storing a decoding table defining the inverse of said encoding table mapping and means, responsive to a label signal received at said destination from said channel, for decoding said received label signal as the one of said p levels associated with said received label signal in said decoding table inverse mapping when said received label signal is one of said p label signals, and speech synthesizer means responsive to said decoding means for synthesizing speech based at least in part on said decoded label signal, wherein said encoding table mapping stored by said encoder memory means and said decoding table inverse mapping stored by said decoder memory means are obtained to minimize the effect of channel errors and are obtained using simulated annealing based on a probability distribution of said p levels for said one parameter signal.

24. Speech processing apparatus in accordance with claim 23 wherein said model is a code excited linear prediction model.

25. Speech processing apparatus in accordance with claim 23 wherein said encoding table mapping and said decoding table mapping are obtained to minimize distortion in said synthesized speech.

* * * * *